United States Patent [19]

Takiguchi et al.

[11] Patent Number: 4,704,351

[45] Date of Patent: Nov. 3, 1987

[54] DYE SENSITIZED LIGHT-SENSITIVE CORE/SHELL SILVER HALIDE PHOTOGRAPHIC MATERIAL

[75] Inventors: Hideki Takiguchi; Yoshitaka Yamada; Hirofumi Ohtani; Hiroshi Kashiwagi, all of Hino, Japan

[73] Assignee: Konishiroku Photo Industry Co., Ltd., Tokyo, Japan

[21] Appl. No.: 769,762

[22] Filed: Aug. 26, 1985

Related U.S. Application Data

[63] Continuation of Ser. No. 558,848, Dec. 7, 1983, abandoned.

[30] Foreign Application Priority Data

Dec. 13, 1982 [JP] Japan ..... 57-219066

[51] Int. Cl.[4] ..... G03C 1/19

[52] U.S. Cl. ..... 430/567; 430/574

[58] Field of Search ..... 930/574, 567, 569

[56] References Cited

U.S. PATENT DOCUMENTS

| | | | |
|---|---|---|---|
| 3,506,443 | 4/1970 | Motter | 430/506 |
| 3,672,898 | 6/1972 | Schwan et al. | 430/507 |
| 4,414,306 | 11/1983 | Wey et al. | 430/567 |
| 4,433,048 | 2/1984 | Solberg et al. | 430/496 |
| 4,444,877 | 4/1984 | Koitabushi et al. | 430/567 |
| 4,565,778 | 1/1986 | Miyamoto et al. | 430/567 |

FOREIGN PATENT DOCUMENTS 54-48521 4/1979 Japan .

*Primary Examiner*—Richard L. Schilling

*Attorney, Agent, or Firm*—Frishauf, Holtz, Goodman & Woodward

[57] ABSTRACT

There is disclosed a light-sensitive silver halide photographic material which has at least one silver halide emulsion layer on a support, the silver halide emulsion layer includes substantially monodispersed core/shell type silver halide grains, and the silver halide grains are those which have been sensitized with a combination of at least one of sensitizing dyes represented by the following formulae (I) and (II):

(I)

(II)

wherein $R_1$ to $R_8$, $Y_1$ to $Y_3$, $Z_1$ to $Z_8$, $X_1\ominus$, $X_2\ominus$, m and n have the same meanings as defined in the specification.

12 Claims, No Drawings

DYE SENSITIZED LIGHT-SENSITIVE CORE/SHELL SILVER HALIDE PHOTOGRAPHIC MATERIAL

This application is a continuation of application Ser. No. 558,848, filed Dec. 7, 1983, now abandoned.

BACKGROUND OF THE INVENTION

This invention relates to a light-sensitive silver halide photographic material which has undergone a spectral sensitization, more particularly to a light-sensitive silver halide photographic material in which the spectral sensitivity in a red light-sensitive region is heightened, and the occurence of a photographic fog is restrained, and a storability with time is also improved.

With regard to the light-sensitive silver halide photographic material, there is now demanded the light-sensitive material having such photographic properties that the reproducibility of a color is not affected by a type of light source used at the time of a shot. It is considered to be suitable that a sensitizing maximum wave length of the light-sensitive layer sensitive to a red light region is set to the range of 620 to 650 nm and adjustment is made so that the spectral sensitivity in a wave length of 580 to 600 nm may be at least 40% of a maximum spectral sensitivity.

A technique of such a spectral sensitization, which is now suggested, comprises spectrally sensitizing a silver halide emulsion by the use of a combination of, for example, a benzothiazolecarbocyanine sensitizing dye and a benzimidazolecarbocyanine sensitizing dye or a benzimidazolothiacarbocyanine sensitizing dye. Such techniques disclosed in, for example, Japanese Patent Publications Nos. 6209/1974, 1569/1980 and 39460/1981; and Japanese Provisional Patent Publication No. 114419/1974, etc. However, the silver halide emulsion, which has undergone the spectral sensitization in the presence of the combination of such sensitizing dyes, is poor in the storability with time and has the drawback that a photographic fog is liable to occur during its storage, particularly at elevated temperature.

On the other hand, for the purpose of improving an image quality of the high-sensitivity light-sensitive silver halide photographic material (hereinafter referred simply to as the light-sensitive material), a variety of techniques has heretofore been developed. For example, one well known technique, by which image qualities such as gradation, graininess and sharpness are improved, comprises adding silver iodide to a silver halide composition, especially silver halide grains in order to utilize a development inhibition effect by virtue of iodine ions given off at the time of development.

For example, the silver halide emulsion used as the light-sensitive silver halide material for black-and-white photography generally contains 2 mole % or more of silver iodide, therefore this emulsion can be utilized in the above-mentioned technique with the intention of regulating the image qualities. Further, in particular, the light-sensitive silver halide material for color photography generally contains 4 mole % or more silver iodide. Thus the aforesaid technique can be utilized more effectively in the presence of this material. Such a high content of silver iodide is suitable for the improvement in the image qualities but it is not always preferred for the betterment of sensitivity, because the silver iodide acts to inhibit a sulfur sensitization reaction during a chemical ripening or a development reaction during a chemical ripening.

A desensitization resulting from the above inhibitive action at the chemical ripening or development can be fairly recovered, for example, by adding a greater amount of a sulfur sensitizer, a gold sensitizer or the like to the emulsion at the chemical ripening, but this disadvantageously deteriorates a stability with time of the emulsion solution, the light-sensitive material and the like.

Further, when the silver halide emulsion including silver iodide in great quantities is subjected to the spectral sensitization mentioned above, the photographic fog will occur very noticeably.

Accordingly, a first object of this invention is to provide a light-sensitive material which has a less photographic fog and a high red light sensitivity, when silver halide grains including silver iodide as a silver halide component are spectrally sensitized in a red light region.

A second object of this invention is to provide a light-sensitive material which has a less photographic fog and a high red light sensitivity, even after it has been stored at elevated temperature for a long period of time.

SUMMARY OF THE INVENTION

The inventors have repeatedly researched into various problems of the aforesaid conventional techniques and have found that the above-mentioned objects can be achieved by a light-sensitive silver halide photographic material having at least one silver halide emulsion layer on a support, characterized in that the silver halide emulsion layer includes substantially monodispersed silver halide grains; the silver halide grains are core/shell type silver halide grains in which a silver iodide content is higher in core portions than in shell portions; and the silver halide grains are those which have been sensitized with a combination of at least one of sensitizing dyes represented by the following general formula (I) and at least one of sensitizing dyes represented by the following general formula (II):

General formula (I)

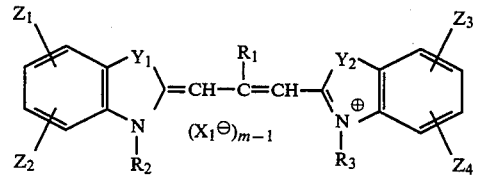

wherein $R_1$ represents a hydrogen atom, an alkyl group or aryl group; $R_2$ and $R_3$ each represent an alkyl group; $Y_1$ and $Y_2$ each represent a sulfur atom or selenium atom; $Z_1$, $Z_2$, $Z_3$ and $Z_4$ each represent a hydrogen atom, halogen atom, hydroxyl group, alkoxy group, amino group, acylamido group, acyloxy group, alkoxycarbonyl group, alkoxycarbonylamino group, aryl group, alkyl group or cyano group, the $Z_1$ and $Z_2$, and/or the $Z_3$ and $Z_4$ may be coupled to each other to form a ring; $X_1\ominus$ represents an anion; and m is an integar of 1 or 2, provided that the sensitizing dye forms an internal salt when the m is 1;

General formula (II)

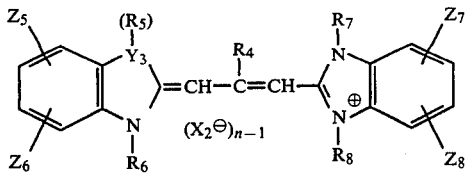

wherein $R_4$ is a hydrogen atom, alkyl group or aryl group; $R_5$, $R_6$, $R_7$ and $R_8$ each represent an alkyl group; $Y_3$ represents a nitrogen atom, sulfur atom or selenium atom, provided that the $Y_3$ is the sulfur atom or selenium atom, the $R_5$ is not present; $Z_5$, $Z_6$, $Z_7$ and $Z_8$ each represent a hydrogen atom, halogen atom, hydroxyl group, alkoxy group, amino group, acylamido group, acyloxy group, alkoxycarbonyl group, aryloxycarbonyl group, alkoxycarbonylamino group, aryl group, alkyl group, cyano group or sulfonyl group, the $Z_5$ and $Z_6$, and/or the $Z_7$ and $Z_8$ may be coupled to each other to form a ring; $X_2^{\ominus}$ represents an anion; and n is an integer of 1 or 2, provided that the sensitizing dye forms an internal salt when the n is 1.

That is to say, in the characteristic light-sensitive material of this invention, the silver halide emulsion layer formed on the support includes the substantially monodispersed core/shell type silver halide grains in which a silver iodide content is higher in the core portions than in the shell portions, and the silver halide grains are those that have spectrally sensitized with the combination of sensitizing dyes represented by the aforesaid general formulae (I) and (II). Therefore, the sensitization method according to this invention permits obtaining a high sensitivity effective in the red light region without any occurrence of the photographic fog, and the light-sensitive material which has undergone the spectral sensitization according to this invention can stably keep up the high sensitivity and the less fog in the course of the storage at a high temperature for a long period of time.

DESCRIPTION OF THE PREFERRED EMBODIMENTS

Now, this invention will be further described in detail.

The sensitizing dyes used in this invention can be represented by general formulae (I) and (II).

In general formula (I), the alkyl group which the $R_1$ represents preferably include lower alkyl groups, for example, methyl, ethyl and propyl groups, but the ethyl group is preferable. Further, the aryl groups also represented by the $R_1$ include a phenyl group.

The alkyl groups which the $R_2$ and $R_3$ represent include preferably lower alkyl groups, for example, methyl, ethyl and butyl groups as well as groups having substituents, for example, sulfoethyl, sulfopropyl, carboxypropyl and sulfobutyl groups, but the sulfopropyl group is preferable.

Further, the halogen atoms which the $Z_1$, $Z_2$, $Z_3$ and $Z_4$ represent include, for example, chlorine, bromine, iodine and fluorine, and at least one of the $Z_1$ and $Z_2$ and at least one of the $Z_3$ and $Z_4$ are precferably chlorine atoms. The alkoxy groups also represented by them include, for example, methoxy, ethoxy, propoxy and butoxy groups. Examples of the amino groups represented thereby include amino, methylamino, dimethylamino and diethylamino groups. The acylamido groups above include, for example, acetamido and propionamido groups. Examples of the acyloxy groups include acetoxy and propionoxy groups. Examples of the alkoxycarbonyl groups include ethoxycarbonyl and propoxycarbonyl groups. Examples of the alkoxycarbonylamino groups include ethoxycarbonylamino, propoxycarbonylamino and butoxycarbonylamino groups. Examples of the aryl groups include phenyl and tolyl groups. The alkyl groups are preferably lower alkyl groups, and they include, for example, methyl, ethyl and propyl groups.

The ring formed by the coupling of the $Z_1$ and $Z_2$, and/or the $Z_3$ and $Z_4$ is a benzene ring, but it is preferred that the $Z_1$ and $Z_2$ as well as the $Z_3$ and $Z_4$ form the benzene rings together. This benzene ring may have a substituent. Further, the anions which the $X_1^{\ominus}$ in general formula (I) represents, for example, chlorides, bromides, iodides, thiocyanates, sulfamates, methyl sulfate, ethyl sulfate, perchlorates and p-toluene sulfonate.

In general formula (II), the alkyl groups which the $R_4$ represents preferably are lower alkyl gorups, and they include, for example, methyl, ethyl and propyl groups. The aryl groups also represented by the $R_4$ includes a phenyl group. The alkyl groups which the $R_5$, $R_6$, $R_7$ and $R_8$ represent are preferably lower alkyl groups, and they include, for example, methyl, ethyl and butyl as well as groups having substituents, for example, sulfoethyl, carboxypropyl and sulfobutyl.

Further, the halogen atoms which the $Z_5$, $Z_6$, $Z_7$ and $Z_8$ represent include, for example, chlorine, bromine, iodine and fluorine. The alkoxy groups also represented by them include, for example, methoxy, ethoxy, propoxy and butoxy groups. Examples of the amino groups represented thereby include amino, methylamino, dimethylamino and diethylamino groups. The acylamido groups above include, for example, acetamido and propionamido groups. Examples of the acyloxy groups include, for example, acetoxy and propionoxy groups. Examples of the alkoxycarbonyl groups include ethoxycarbonyl and propoxycarbonyl groups. Examples of the aryloxycarbonyl groups include a phenoxycarbonyl group. The alkoxycarbonylamino groups include, for example, ethoxycarbonylamino, propoxycarbonylamino and butoxycarbonylamino groups. Examples of the aryl groups include phenyl and tolyl groups. The alkyl groups, are preferably lower alkyl groups, and they include, for example, methyl, ethyl and propyl groups. And the sulfonyl groups include morpholinosulfonyl and piperidinosulfonyl groups. The ring formed by the pair of $Z_5$ and $Z_6$, and/or the pair of $Z_7$ and $Z_8$ is a benzene ring, and this benzene ring may have a substituent. Further, the anions which the $X_2^-$ in general formula (II) represents include, for example, chlorides, bromides, iodides, thiocyanates, sulfamates, methyl sulfate, ethyl sulfate, perchlorates and p-toluene sulfonate.

Now, typical sensitizing dyes for use in this invention which general formula (I) represents will be recited as follows, but this invention is not to be limited to these dyes.

Example compounds
(I-1)
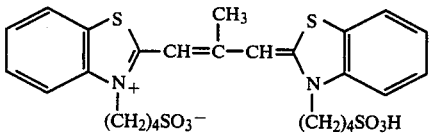
(I-2)
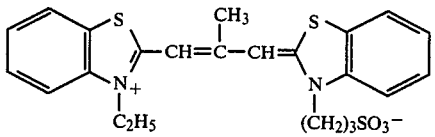
(I-3)
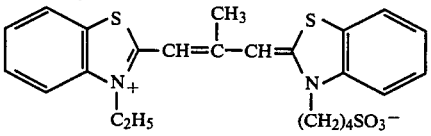
(I-4)
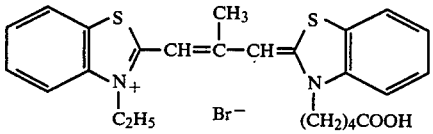
(I-5)
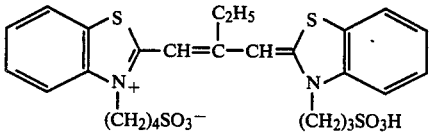
(I-6)
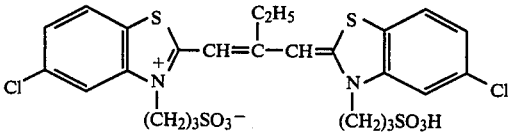
(I-7)
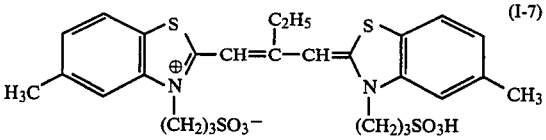
(I-8)
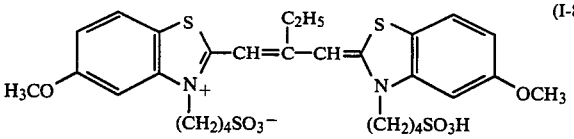
(I-9)
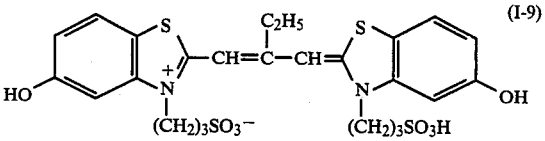
(I-10)
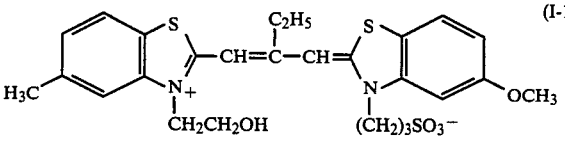
(I-11)
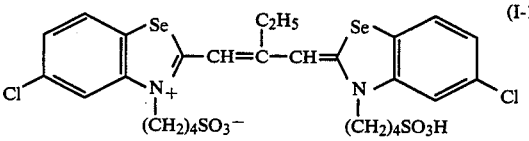
(I-12)
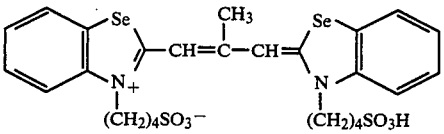
(I-13)
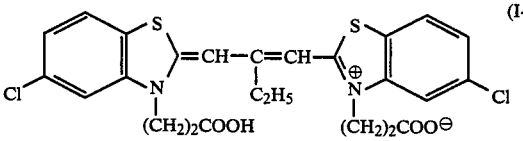
(I-14)
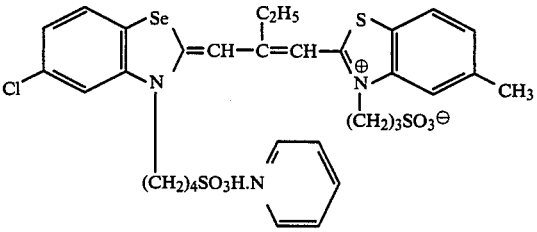
(I-15)
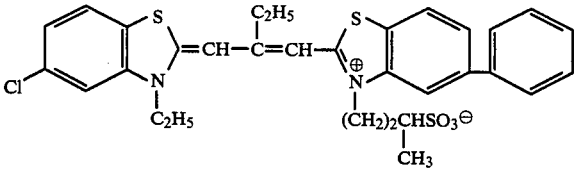
(I-16)
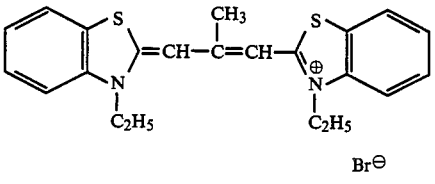
(I-17)
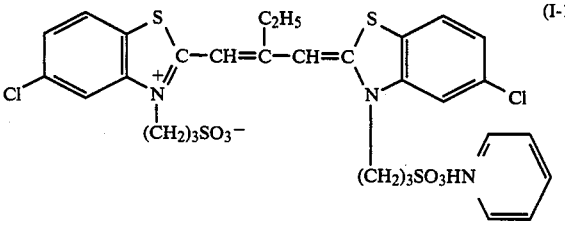

-continued
Example compounds
(I-18)
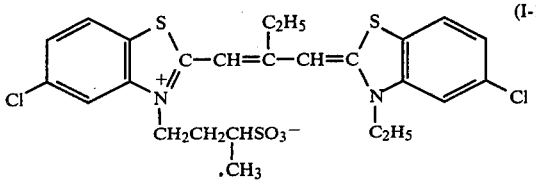
(I-19)
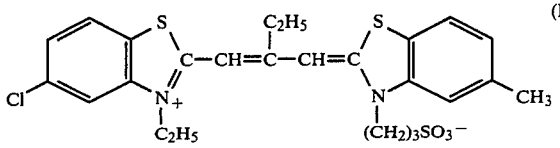
(I-20)
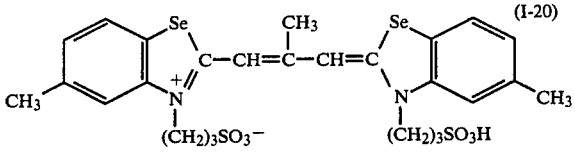
(I-21)
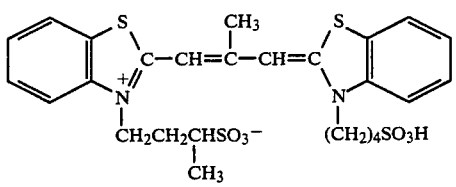
(I-22)
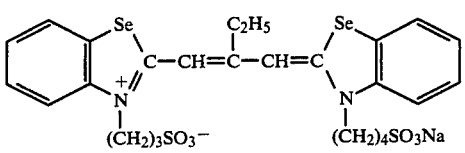
(I-23)
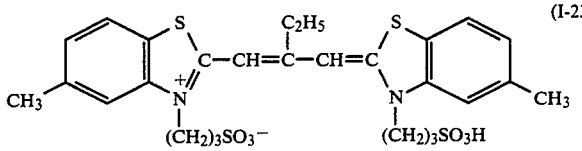
(I-24)
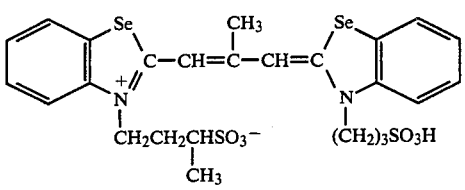
(I-25)
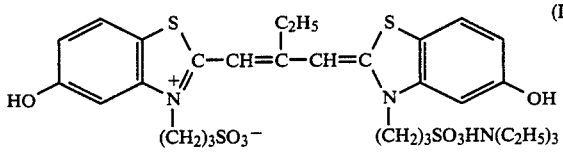
(I-26)
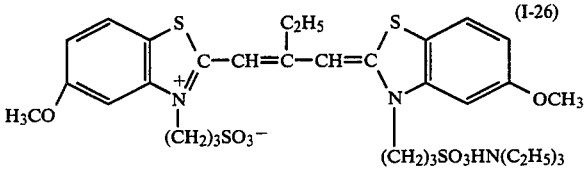
(I-27)
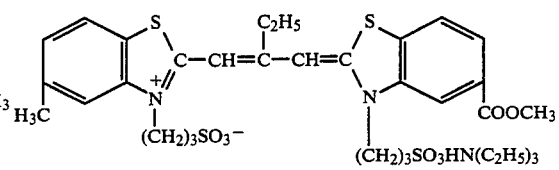
(I-28)
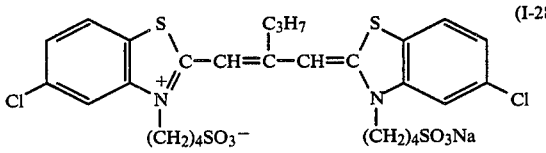
(I-29)
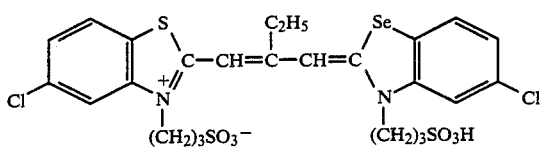
(I-30)
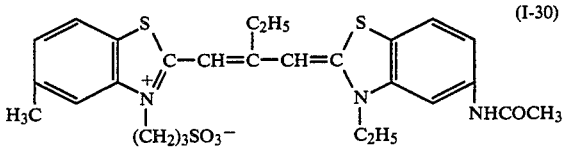
(I-31)
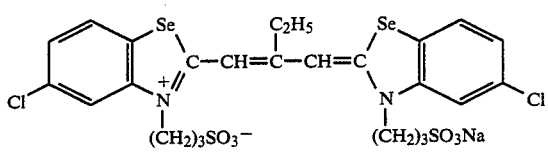
(I-32)
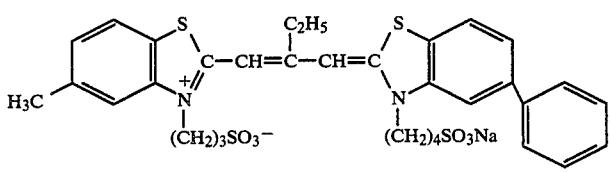
(I-33)
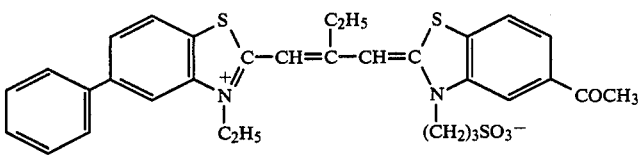

-continued
Example compounds
(I-34)
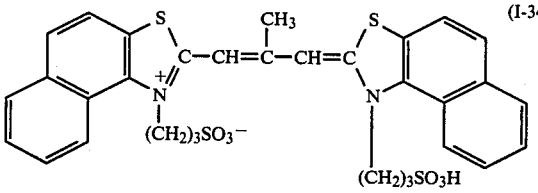
(I-35)
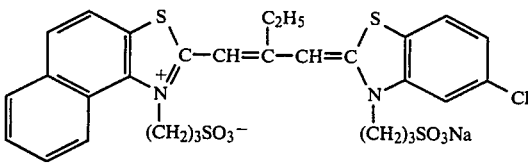
(I-36)
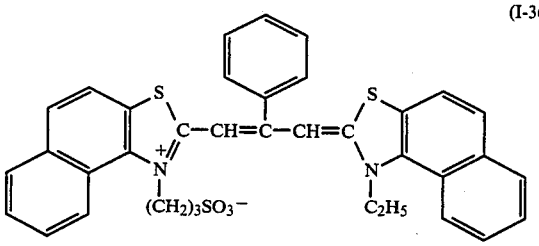
(I-37)
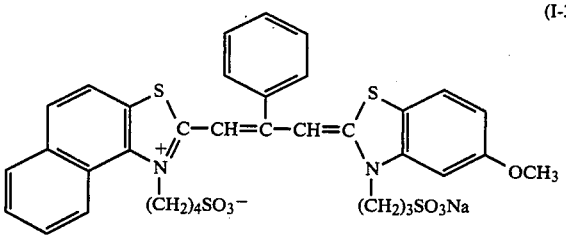
(I-38)
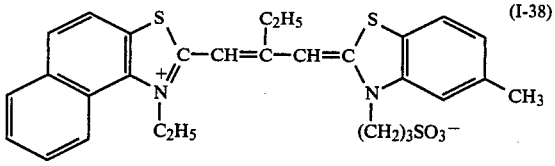
(I-39)
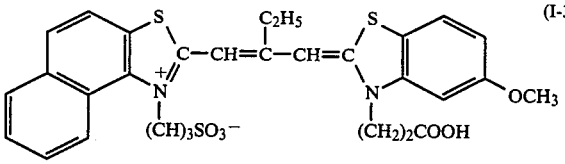
(I-40)
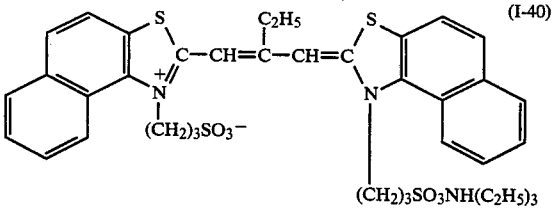
(I-41)
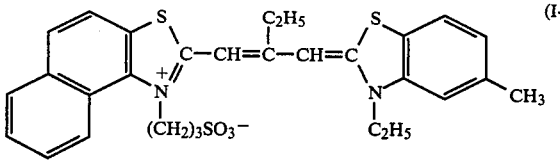
(I-42)
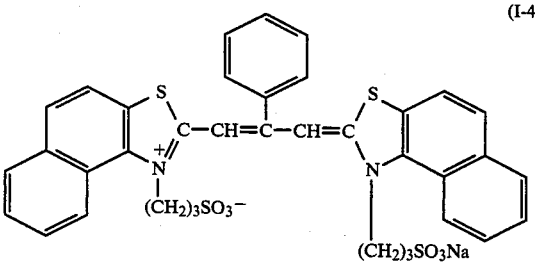
(I-43)
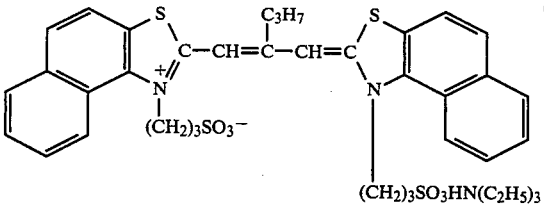
(I-44)
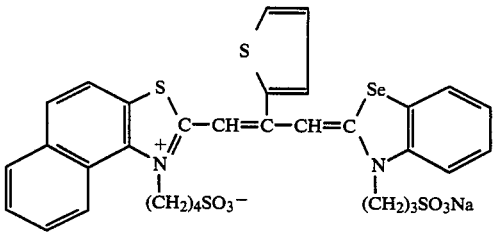
(I-45)
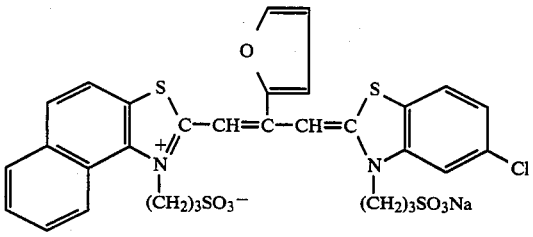
(I-46)
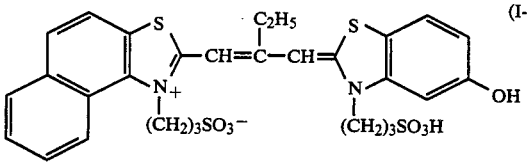
(I-47)
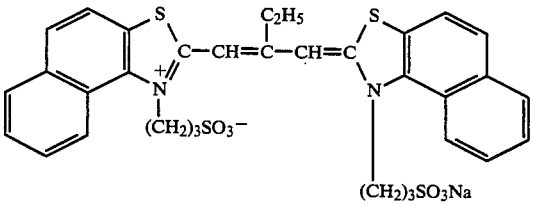

-continued

Example compounds (I-48)

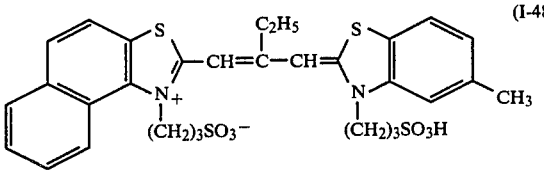

Among the sensitizing dyes which general formula (II) regarding this invention represents, partiularly preferable sensitizing dyes can be denoted by the following general formulae (IIA) and (IIB).

General formula (IIA)

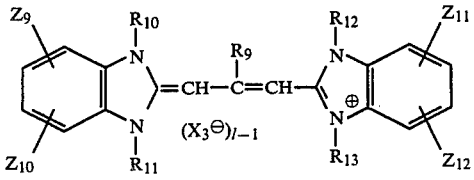

wherein $R_9$ represents a hydrogen atom, a lower alkyl group (e.g., a methyl, ethyl or propyl group) or an aryl group (e.g., a phenyl group), but it is preferably the hydrogen atom; $R_{10}$, $R_{11}$, $R_{12}$ and $R_{13}$ each represent a lower alkyl group (e.g., a methyl, ethyl or butyl group as well as a sulfoethyl, sulfopropyl, carboxypropyl or sulfobutyl group having a substituent), but each of them is preferably the ethyl, sulfopropyl or sulfobutyl group; $Z_9$, $Z_{10}$, $Z_{11}$ and $Z_{12}$ each represent a hydrogen atom, a halogen atom (which is, e.g. chlorine, bromine, iodine or fluorine atom, but the $Z_9$, $Z_{10}$, $Z_{11}$ and $Z_{12}$ all are preferably the chlorine atom), a hydroxyl group, an alkoxy group (which is, e.g., a methoxy, ethoxy, propoxy or butoxy group, but at least one of the $Z_9$ and $Z_{10}$ and at least one of the $Z_{11}$ and $Z_{12}$ are each preferably the butoxy group), an amino group (e.g., an amino, methylamino, dimethylamino or diethylamino group), an acylamido group (e.g., an acetamido, propionamido or butyramido group), an acyloxy group (e.g., an acetoxy or propionoxy group), an alkoxycarbonyl group (e.g., an ethoxycarbonyl or propoxycarbonyl group), an aryloxycarbonyl group (e.g., a phenoxycarbonyl group), an alkoxycarbonylamino group (e.g., an ethoxycarbonylamino, propoxycarbonylamino and butoxycarbonylamino group), an aryl group (e.g., a phenyl group), a lower alkyl group (e.g., a methyl, ethyl or propyl group), a sulfonyl group (e.g., a morpholinosulfonyl or piperidinosulfonyl group), and a cyano group (at least one of the $Z_9$ and $Z_{10}$ and at least one of the $Z_{11}$ and $Z_{12}$ are each preferably a cyano group), the $Z_9$ and $Z_{10}$, and/or the $Z_{11}$ and $Z_{12}$ are coupled to each other to form a ring, but this ring is, for example, a benzene ring; $X_3\ominus$ represents an anion (e.g., a chloride, bromide, iodide, thiocyanate, sulfamate, methyl sulfate, ethyl sulfate, perchlorate or p-toluene sulfonate); l is an integer of 1 or 2, provided that the sensitizing dye forms an internal salt when the l is 1.

Now, typical senstitizing dyes for use in this invention which general formula (IIA) represents will be recited as follows, but this invention is not limited to these dyes.

Example compounds (IIA-1)

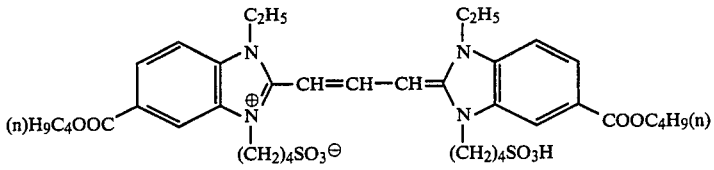

(IIA-2)

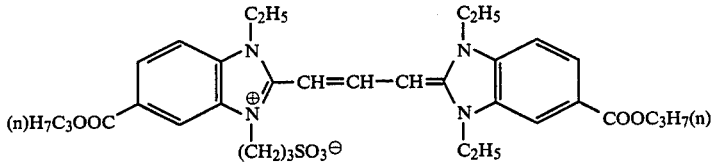

(IIA-3)

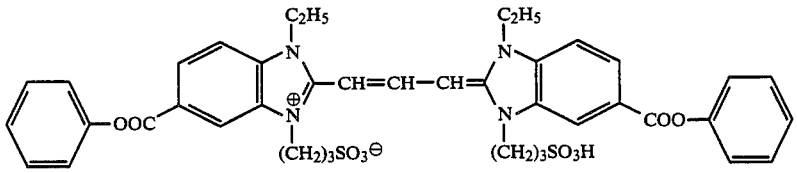

-continued
Example compounds
(IIA-4)
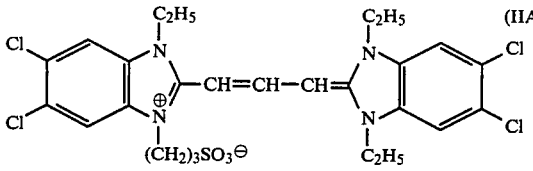
(IIA-5)
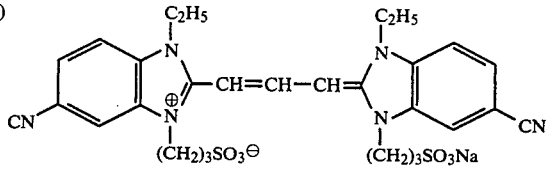
(IIA-6)
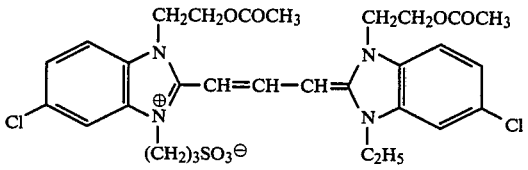
(IIA-7)
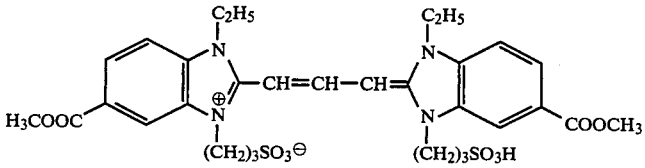
(IIA-8)
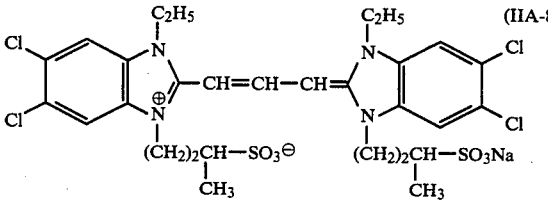
(IIA-9)
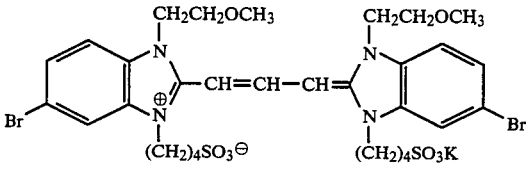
(IIA-10)
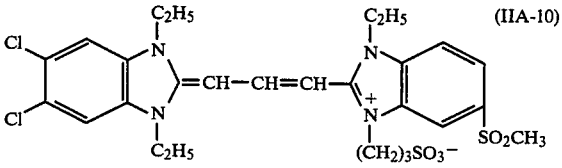
(IIA-11)
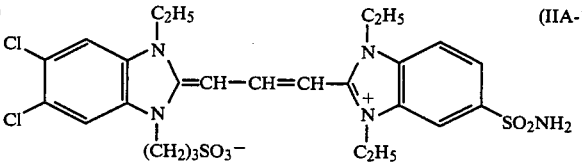
(IIA-12)
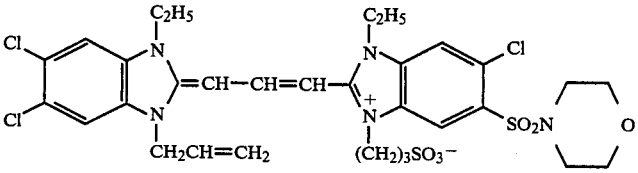
(IIA-13)
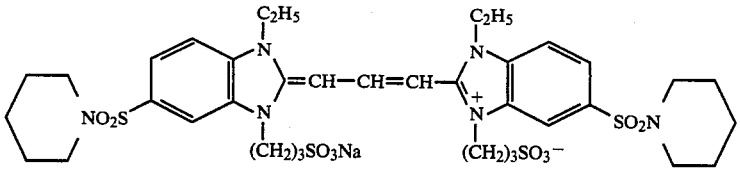
(IIA-14)
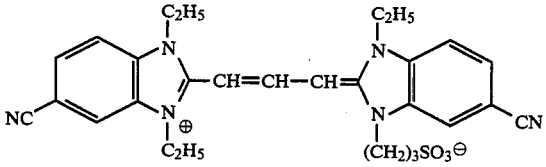

-continued
Example compounds
(IIA-15)
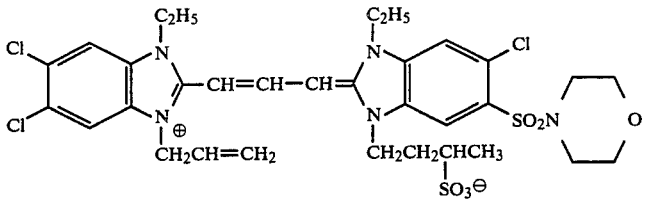
(IIA-16)
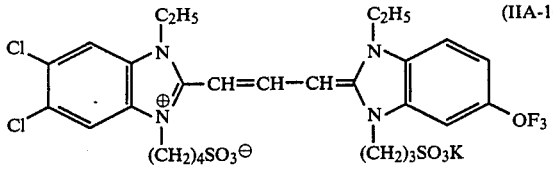
(IIA-17)
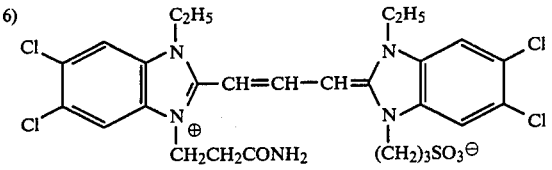
(IIA-18)
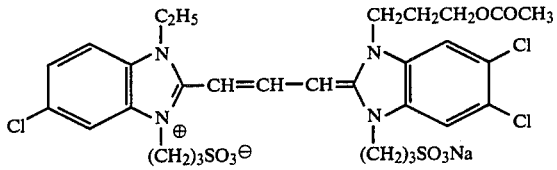
(IIA-19)
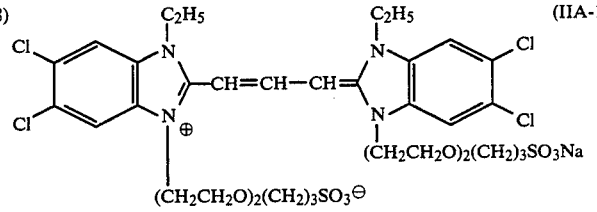
(IIA-20)
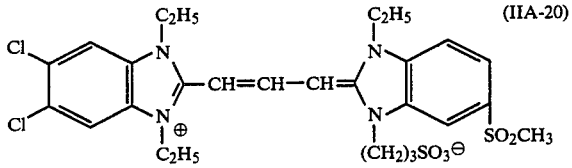
(IIA-21)
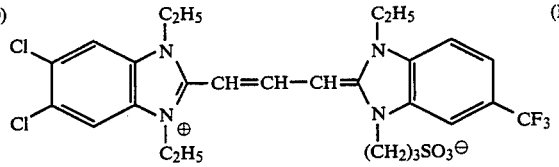
(IIA-22)
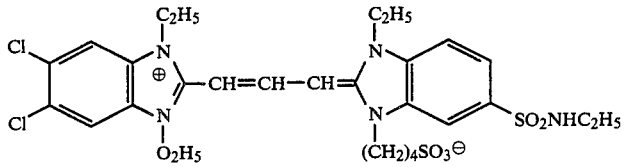
(IIA-23)
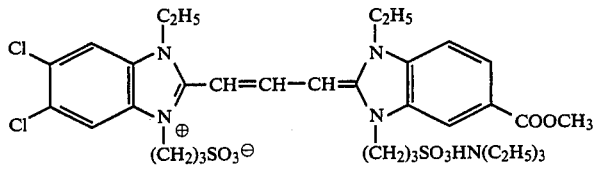
(IIA-24)
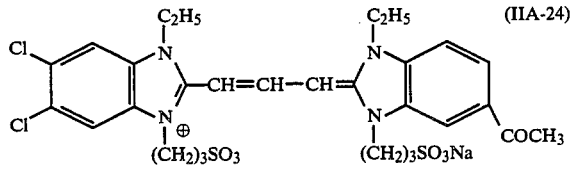
(IIA-25)
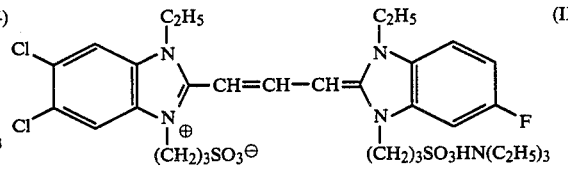
(IIA-26)
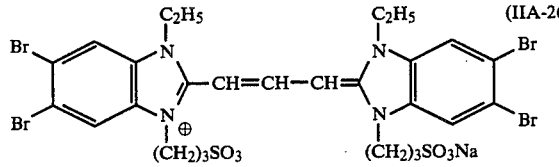
(IIA-27)
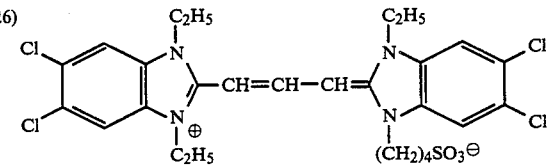

-continued

Example compounds

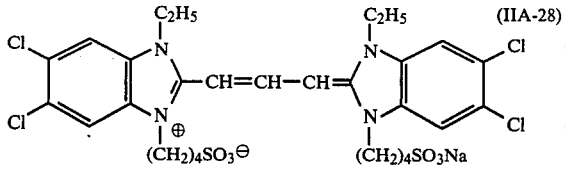

(IIA-28)

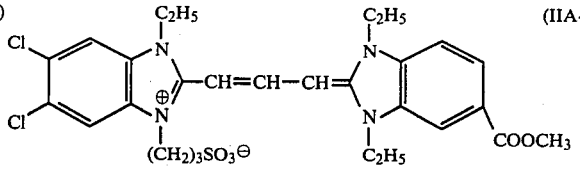

(IIA-29)

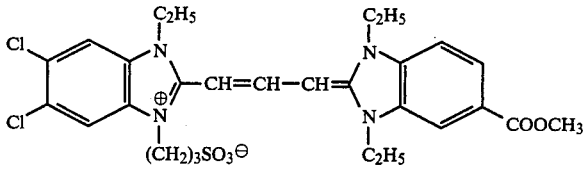

(IIA-30)

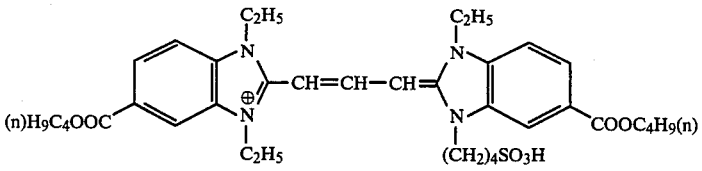

(IIA-31)

$Br^{\ominus}$

General formula (IIB)

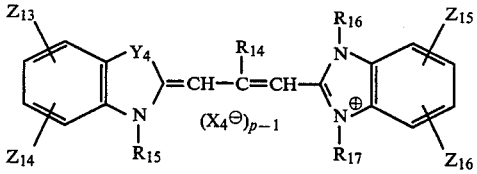

wherein $Y_4$ represents a sulfur atom or selenium atom; $R_{14}$ represents a hydrogen atom, a lower alkyl group (e.g., a methyl, ethyl or propyl group) or an aryl group (e.g., a phenyl group), but it is preferably the hydrogen atom; $R_{15}$, $R_{16}$ and $R_{17}$ each represent a lower alkyl group (e.g., a methyl, ethyl or butyl group as well as a sulfoethyl, sulfopropyl, carboxypropyl or sulfobutyl group having a substituent), but they are preferably the ethyl and sulfopropyl groups; $Z_{13}$, $Z_{14}$, $Z_{15}$ and $Z_{16}$ each represent a hydrogen atom, a halogen atom (e.g., a chlorine, bromine, iodine or fluorine atom), a hydroxyl group, an alkoxy group (e.g., a methoxy, ethoxy, propoxy or butoxy group), an amino group (e.g., an amino, methylamino, dimethylamino or diethylamino group), an acylamido gorup (e.g., an acetamido and propionamido group), an acyloxy group (e.g., an acetoxy or propionoxy group), an alkoxycarbonyl group (e.g., an ethoxycarbonyl or propoxycarbonyl group), an alkoxycarbonylamino group (e.g., an ethoxycarbonylamino, propoxycarbonylamino and butoxycarbonylamino group), an aryl group (e.g., a phenyl group), a lower alkyl group (e.g., a methyl, ethyl or propyl group), and a sulfonyl group, the $Z_{13}$ and $Z_{14}$, and/or the $Z_{15}$ and $Z_{16}$ are coupled to each other to form a ring, but this ring is, for example, a benzene ring, preferably, the $Z_{13}$ and $Z_{14}$ are coupled to form the benzene ring, and at least one of the $Z_{15}$ and $Z_{16}$ is a methyl trifluoride; $X_4^{\ominus}$ represents an anion (e.g., a chloride, bromide, iodide, thiocyanate, sulfamate, methyl sulfate, ethyl sulfate, perchlorate or p-toluene sulfonate); and p is an integer of 1 or 2, provided that the sensitizing dye forms an internal salt when the p is 1.

Now, typical sensitizing dyes for use in this invention which general formula (IIB) represents will be recited as follows, but this invention is not limited ot these dyes.

Example compounds

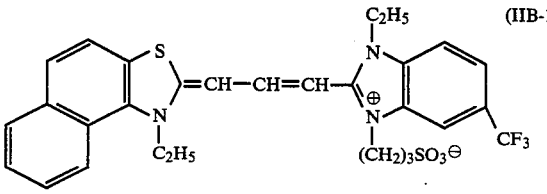

(IIB-1)

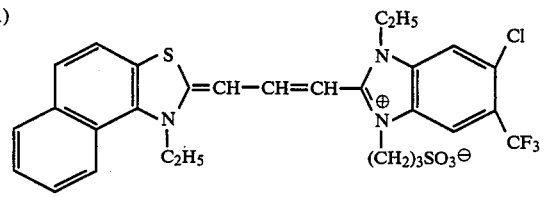

(IIB-2)

-continued
Example compounds
(IIB-3)
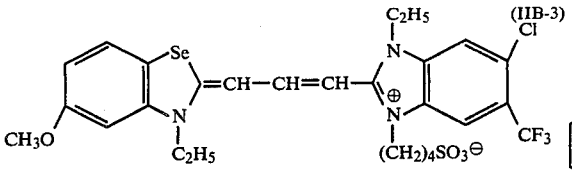
(IIB-4)
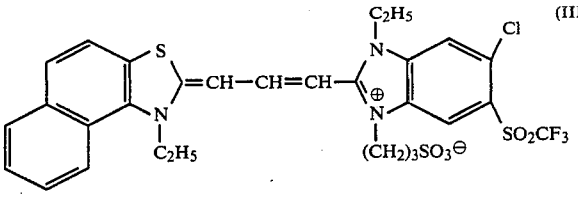
(IIB-5)
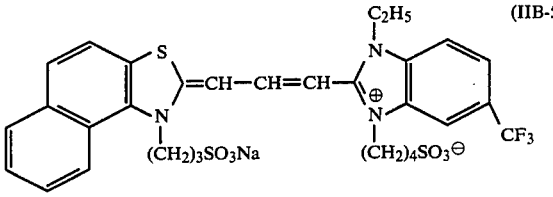
(IIB-6)
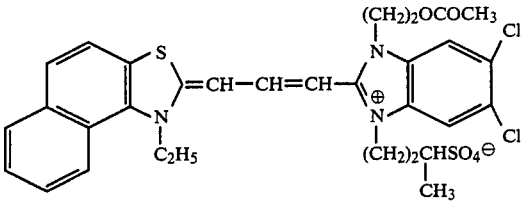
(IIB-7)
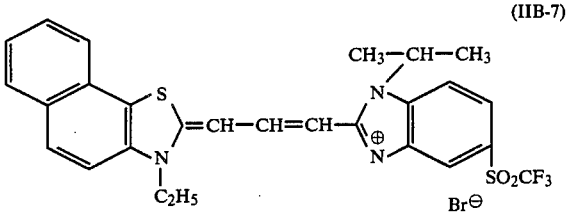
(IIB-8)
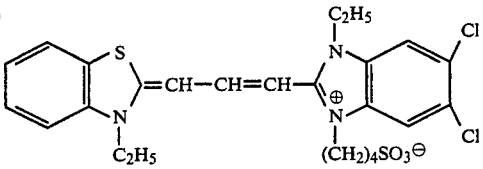
(IIB-9)
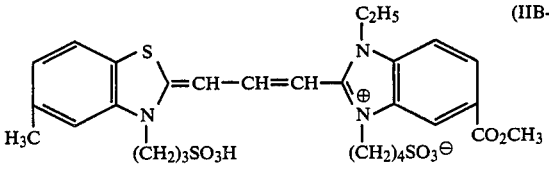
(IIB-10)
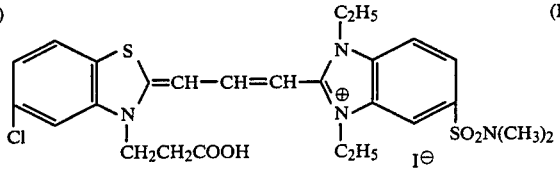
(IIB-11)
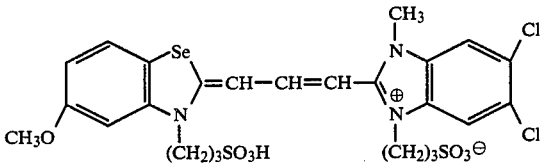
(IIB-12)
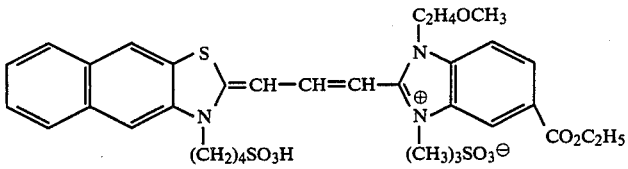
(IIB-13)
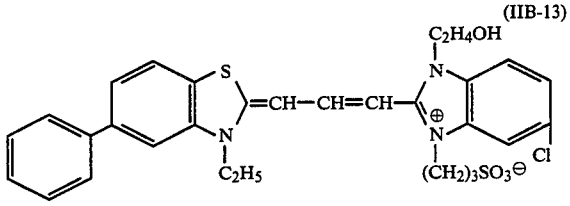
(IIB-14)
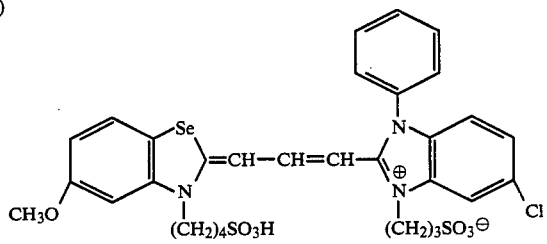

-continued
Example compounds
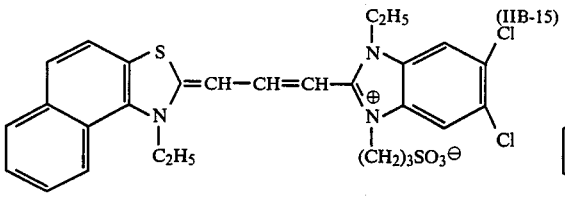
(IIB-15)
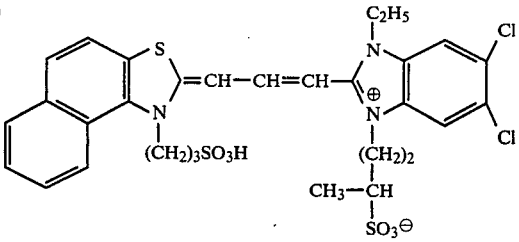
(IIB-16)
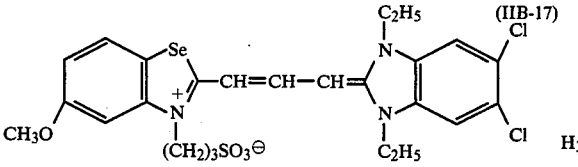
(IIB-17)
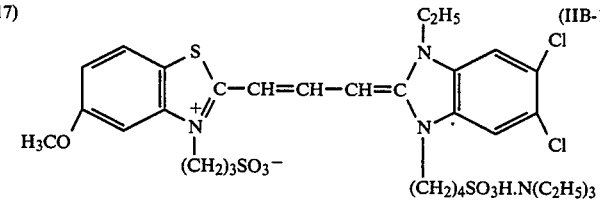
(IIB-18)
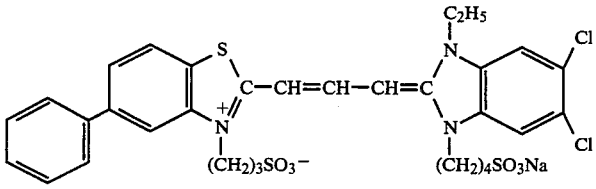
(IIB-19)
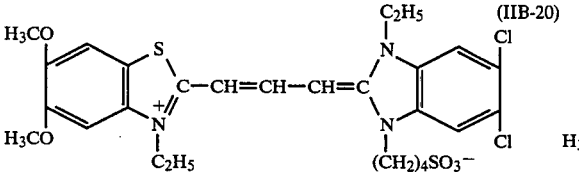
(IIB-20)
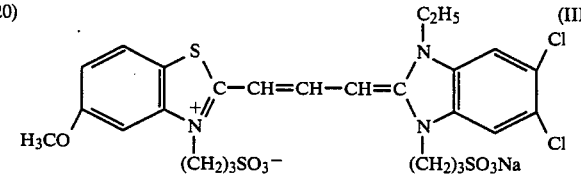
(IIB-21)
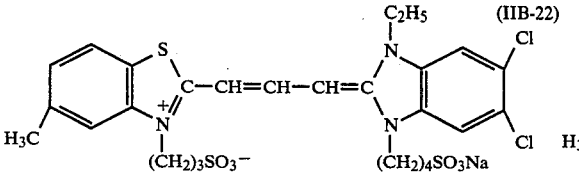
(IIB-22)
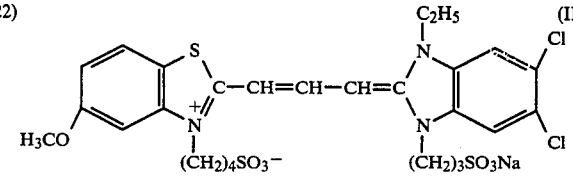
(IIB-23)
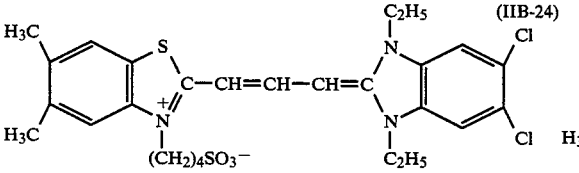
(IIB-24)
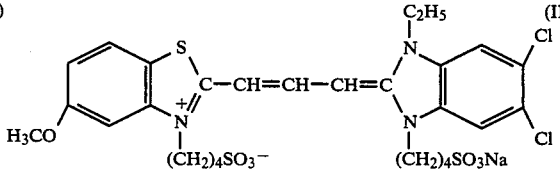
(IIB-25)
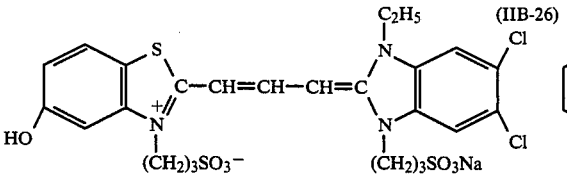
(IIB-26)
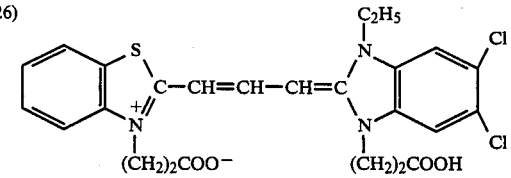
(IIB-27)
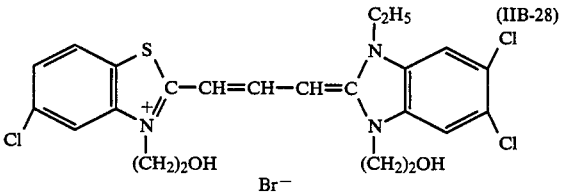
(IIB-28)

The sensitizing dyes represented by the above-mentioned general formulae (I) and (II) used in this invention are described in Japanese Provisional Patent Publications No. 114419/1974, No. 1569/1980 and No. 39460/1981 and can be synthesized in accordance with these inventions.

According to the present invention, a red sensitive sensitizing dye can further be used in combination with the sensitizing dyes represented by the above-mentioned formulae (I) and (II).

The preferable red sensitive dyes which can be employed in combination with the sensitizing dyes regarding this invention can be represented by the following general formula (III):

General formula (III)

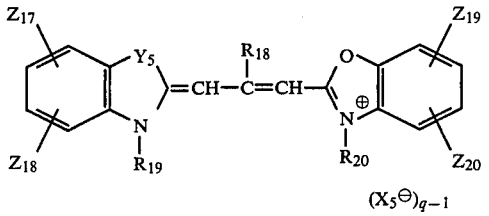

wherein $Y_5$ represents a sulfur atom or selenium atom; $R_{18}$ represents a hydrogen atom, a lower alkyl group (e.g., a methyl, ethyl or propyl group) or an aryl group (e.g., a phenyl group), but it is preferably the ethyl group; $R_{19}$ and $R_{20}$ each represent a lower alkyl group (e.g., a methyl, ethyl and butyl group as well as a sulfoethyl, carboxypropyl or sulfobutyl group having a substituent), but it is preferred that the $R_{19}$ is the ethyl group and the $R_{20}$ is the sulfobutyl group; $Z_{17}$, $Z_{18}$, $Z_{19}$ and $Z_{20}$ each represent a hydrogen atom, a halogen atom (e.g., a chlorine, bromine, iodine or fluorine atom), a hydroxyl group, an alkoxy group (e.g., a methoxy, ethoxy, propoxy and butoxy group), an amino group (e.g., an amino, methylamino, dimethylamino or diethylamino group), an acylamido group (e.g., an acetamido, propionamido or butyramido group), an acyloxy group (e.g., an acetoxy or propionoxy group), an alkoxycarbonyl group (e.g., an ethoxycarbonyl or propoxycarbonyl group), an alkoxycarbonylamino group (e.g., an ethoxycarbonylamino, propoxycarbonylamino and butoxycarbonylamino group), an aryl group (e.g., a phenyl group), and a lower alkyl group (e.g., a methyl, ethyl or propyl group), but it is preferred that one of the $Z_{17}$ and $Z_{18}$ and one of the $Z_{19}$ and $Z_{20}$ each are the chlorine atom, the $Z_{17}$ and $Z_{18}$, and/or the $Z_{19}$ and $Z_{20}$ may be coupled to each other to form a ring, and this ring is, for example, a benzene ring; $X_5^{\ominus}$ represents an anion (e.g., a chloride, bromide, iodide, thiocyanate, sulfamate, methyl sulfate, ethyl sulfate, perchlorate or p-toluene sulfonate); q is an integer of 1 or 2, provided that the sensitizing dye forms an internal salt when the q is 1.

Now, typical sensitizing dyes for use in this invention which general formula (III) represents will be recited as follows, but this invention is not limited to these dyes.

Example compounds (III-1)

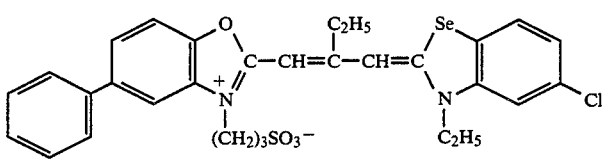

(III-2)

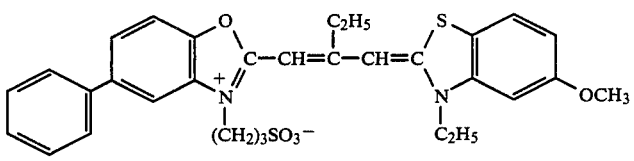

(III-3)

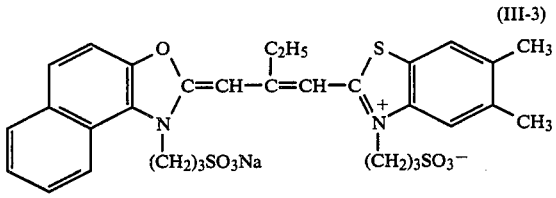

(III-4)

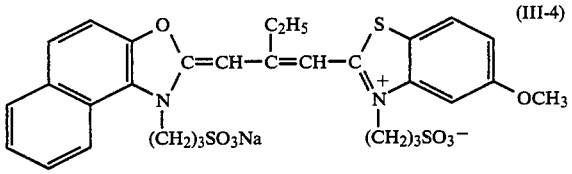

(III-5)

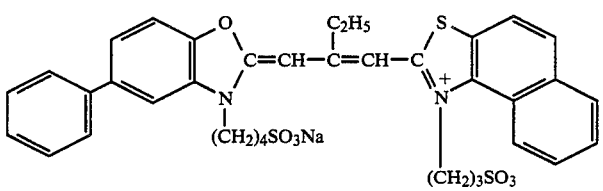

-continued

Example compounds (III-6)

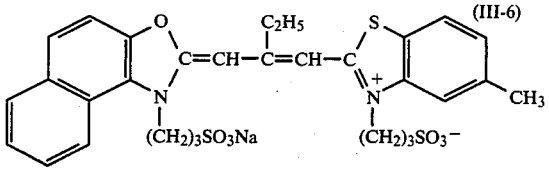

(III-7)

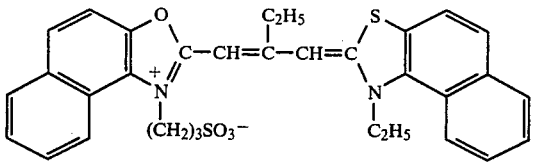

(III-8)

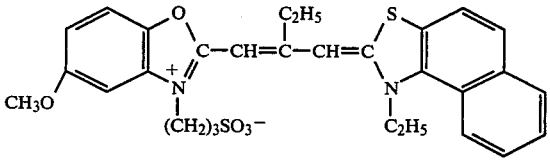

(III-9)

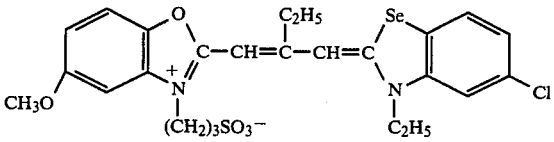

(III-10)

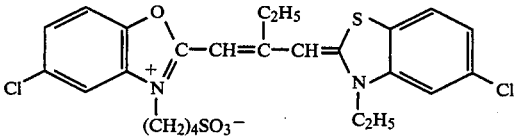

(III-11)

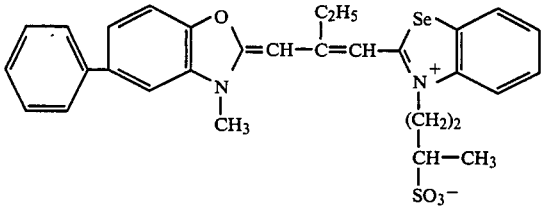

As the supersensitizers other than the sensitizing dyes represented by the above-mentioned general formula (III) which can be used in combination with the sensitizing dyes denoted by the general formulae (I) and (II) regarding this invention, there can be employed, in compliance with uses, benzothiazoles and quinolones described in Japanese Patent Publication No. 24533/1982 and quinoline derivatives described in Japanese Patent Publication No. 24899/1982.

The monodispersed silver halide grains in this invention refer to those which exhibit uniform shapes of individual silver halide grains when the emulsion is observed with an electron microscope photograph, have regular grain sizes, and have a grain size distribution as defined by the following formula. Namely, when the standard deviation S of the grain size distribution is divided by the average grain size $\bar{r}$, its value is 0.20 or less.

$$S = \sqrt{\frac{\Sigma (\bar{r} - r_i)^2 n_i}{\Sigma n_i}}$$

$$\frac{S}{\bar{r}} \leqq 0.20$$

The average grain size herein mentioned refers to an average value of diameters in the case of spherical silver halide grains or an average value of diameters of circular images calculated to be of the same area from the projected images in the case of cubic or other shapes than spheres, and $\bar{r}$ may be defined by the following formula, when individual grain sizes are represented by $r_i$ and their numbers by $n_i$:

$$\bar{r} = \frac{\Sigma n_i r_i}{\Sigma n_i}$$

The above grain sizes can be measured according to various methods generally employed in the related field of art for the above purpose. Representative methods are written in Rubland, "Grain Size Analytical Method", A.S.T.M. Symposium on light microscopy, 1955, pp. 94–122 or "Theory of Photographic Process" by Mieth & James, 3rd edition, Chap. 2, published by Macmillan Co. (1966). This grain size can be measured by use of the projected area of grains or approximate diameter values. When the grains are substantially of uniform shapes, the grain size distribution can be expressed considerably accurately as diameter or projected area.

The relation of the grain size distribution can be determined according to the method described in the essay by Triberi and Smith in "Empirical relation between the sensitometry distribution and grain size distribution in photographic emulsions", The Photographic Journal vol. LXXIX (1949), pp. 330–338.

The silver halide grains to be used in the light-sensitive silver halide photographic material according to this invention may preferably contain 70% or more, particularly preferably all, based on the total grains in the same silver halide emulsion layer of the monodispersed silver halide grains according to this invention.

The substantially monodispersed silver halide grains regarding this invention may be employed alone, and two or more kinds of monodispersed silver halide grains which are different in an average grain size may optionally be preferably mixed and used. Further, two or more kinds of core/shell type silver halide grains which are different in a silver halide iodide content may be preferably mixed and used. Furthermore, in this invention, the silver halide grains which can be efectively spectrally sensitized by the sensitizing dyes (hereinafter referred to as the sensitizing dyes regarding this invention) represented by the above-mentioned general formulae (I) and (II) are each composed of two or more layers which are different in the silver iodide content, and it is preferred that among the two or more layers, an outermost layer (a shell portion) is lower in the average silver iodide content than an inner layer (a core portion).

Further, the core portion inside each grain may comprise two or more layers which are different in the silver iodide content. Furthermore, the layer having the high silver iodide content and the layer having its low content may be bounded sharply, or in an unsharply continuous state.

A distribution state of the silver iodide in the silver halide grains can be detected by a variety of physical measurements, for example, by measuring a luminescence at a low temperature, as described in Annual Congress Lecture Summary Paper published by Nippon Shashin Gakkai in 1981.

The core/shell type silver halide grains regarding this invention is each composed of the core portion comprising the silver halide including silver iodide and the shell portion with which the core portion is coated, the shell portion comprising the silver halide the silver iodide content of which is lower than that of the aforesaid core portion, and it is preferred that the shell portion of each silver halide grain has a thickness of 0.001 to 0.1$\mu$.

As a preferred embodiment of the silver halide grains of this invention, the silver halide composition of said cores is a silver halide containing 2 to 15 mole % of silver iodide and the aforesaid shells comprise substantially silver halide containing 0 to 4 mole % of silver iodide. Further, a difference between the silver iodide contents in the core portions and the shell portions is preferably 5 mole % or more.

With regard to the silver halide grains according to this invention, the silver halide composition other than the aforesaid silver iodide is preferably silver bromide, but it may include silver chloride so long as effects of this invention are not impaired. In this case, the content of the silver chloride is generally less than 1 mole %. An average silver iodide content in the silver halide grains according to this invention is preferably within the range of 0.5 to 15 mole %, more preferably 5 to 12 mole %.

The silver halide grains according to this invention may have a configuration of, for example, hexahedral, octahedral, tetradecahedral, plate or sphere, and may be a mixture of the various grains having these shapes. However, the octahedral and tetradecahedral grains are preferable.

The silver halide emulsion containing the silver halide grains having specific layer constitution of this invention can each be prepared by covering, with a shell, a core comprising a monodispersed silver halide grain.

The monodispersed silver halide grains for the cores having a desired size can be manufactured by the double-jet method, while maintaining a pAg at a constant level. For example, the highly monodispersed silver halide emulsion can be prepared by a method disclosed in Japanese Provisional Patent Publication No. 48521/1979. As one example, it can be produced according to the method in which an aqueous potassium iodobromide-gelatin solution and an aqueous ammoniacal silver nitrate solution are added into an aqueous gelatin solution containing silver halide seed grains, while varying the addition rate as a function of time. During this operation, by suitable selection of the time function of the addition rate, pH, pAg and temperature and the like, it is possible to obtain a highly monodispersed silver halide emulsion.

Referring to the thickness of the shells covering over cores, it must be a thickness which does not shield the preferable properties of the cores, and contrariwise a thickness enough to shield unfavorable properties of the cores. Namely, the thickness is limited to a narrow range delimited by such upper and lower limits. Such shells can be formed by on depositing monodispersed cores a soluble halogen compound solution and a soluble silver salt solution according to the double jet method.

With regard to the manufacturing methods of the above-mentioned core/shell type silver halide grains, for example, West German Pat. No. 1,169,290; U.K. Pat. No. 1,027,146; Japanese Provisional Patent Publication No. 154232/1982 and Japanese Patent Publication No. 1417/1976 can be referred to.

In the manufacturing processes of the silver halide grains of this invention, there may be coexist, for example, a cadmium salt, zinc salt, lead salt, thallium salt, iridium salt, any one of their complex salts, rhodium salt or its complex salt.

In this invention, the spectral sensitization can be carried out by adding the sensitizing dyes regarding this invention to a silver halide emulsion including the monodispersed core/shell type silver halide grains which can be prepared with the above constitution. The addition of the sensitizing dyes can be carried out at the beginning of a chemical ripening (which is also called a second ripening) of the silver halide emulsion, or during the growth of the ripening, or after the completion of the ripening, or at a suitable time prior to the coating operation of the emulsion.

Some sensitizing dyes regarding this invention may be added simultaneously or separately, but the simultaneous addition is preferable.

Adding the sensitizing dyes regarding this invention to the aforesaid photographic emulsion can be accomplished by a variety of manners which have heretofore been suggested. For example, a manner described in U.S. Pat. No. 3,469,987 may be employed in which the sensitizing dyes are first dissolved in a volatile organic solvent, the resulting solution is dispersed in a hydrophilic colloid, and the thus prepared dispersion is added to the emulsion. Further, the sensitizing dyes regarding this invention may separately be dissolved in the same solvent or different solvents, and in the latter case, the resulting solutions may be mixed prior to their addition to the emulsion, or be separately added to the emulsion.

With regard to the solvents for the sensitizing dyes used at the time when these dyes are added to the silver halide emulsion, water-soluble organic solvents such as methyl alcohol, ethyl alcohol and acetone can be preferably used.

An amount of each sensitizing dye to be added to the silver halide emulsion is within the range of $1\times10^{-5}$ mole to $2.5\times10^{-2}$ mole, preferably $1.0\times10^{-4}$ mole to $1.0\times10^{-3}$ mole per mole of the silver halide. A preferable proportion of the respective sensitizing dyes to be used is such that the sensitizing dye represented by general formula (I): one represented by general formula (II) is within the range of 1:0.5 to 0.03.

A variety of general chemical sensitizations can be applied to the silver halide grains used in this invention.

Chemical sensitizers used in such chemical sensitizations include active gelatins; noble metal sensitizers such as water-soluble gold salts, water-soluble platinum salts, water-soluble palladium salts, water-soluble rhodium salts and water-soluble iridium salts; sulfur sensitizers; selenium sensitizers; and reduction sensitizers such as polyamine and stannous chloride, and these sensitizers may be employed alone or combinedly.

In this invention, known types of sulfur sensitizers can be used. Their examples include thiosulfate, allylthiocarbamidothiourea, allylisothiocyanate, cystine, p-toluenethiosulfonate and rhodanine. Besides, there can be employed sulfur sensitizers which are disclosed in U.S. Pat. Nos. 1,574,944, 2,410,689, 2,278,947, 2,728,668, 3,501,313 and 3,656,955; German Pat. No. 1,422,869; Japanese Patent Publication No. 24937/1981; and Japanese Provisional Patent Publication No. 45016/1980. The amount of the sulfur sensitizer is such that it effectively increases the sensitivity of the material. This amount varies over a fairly extensive range under various conditions such as the amount of the used nitrogen-containing heterocyclic compound, a pH, a temperature and the size of the silver halide grains, but about $10^{-7}$ to about $10^{-1}$ mole per mole of the silver halide is preferable, as a standard.

In place of the sulfur sensitizers, this invention allows using selenium sensitizers, which include aliphatic isoselenocyanates such as allylisoselenocyanate, selenoureas, selenoketones, selenoamides, selenocarboxylic acids, selenoesters, selenophosphates, and selenides such as diethylselenide and diethyl diselenide. These examples are disclosed in U.S. Pat. Nos. 1,574,944, 1,602,592 and 1,623,499.

The amount of the selenium sensitizer, as in the case of the sulfur sensitizer, varies over an extensive range, but approximately $10^{-7}$ to $10^{-3}$ mole per mole of the silver halide is preferable, as a standard.

As the gold sensitizers used in this invention, a variety of gold compounds inclusive of ones having oxidation numbers of +1 and +3 can be employed. Typical examples of the gold sensitizers include chloroaurate, potassium chloroaurate, auric trichloride, potassium auric thiocyanate, potassium iodoaurate, tetracyanoauric acid, ammonium aurothiocyanate and pyridyltrichlorogold.

The amount of the gold sensitizer is preferably within the range of about $10^{-7}$ to $10^{-1}$ mole per mole of the silver halide as a standard, though varying with various conditions.

In the sensitization step of this invention, there can also be together used a sensitization process based on another noble metal such as platinum, palladium, iridum or rhodium, or a salt thereof.

In this invention, it is further possible to employ a reduction sensitization together. Usable reducing agents are not particularly limited, but their examples include known stannous chloride, thiourea dioxide, hydrazine derivatives and silane compounds.

It is preferred that the reduction in sensitization is carried out while the silver halide grains grow or after the sulfur sensitization and gold sensitization have been completed.

The aforesaid silver halide grains according to this invention can also be enhanced markedly in chemical sensitizing effect by performing chemical ripening in the presence of a solvent for silver halide.

As the solvent for silver halide to be used in this invention, there may be included (a) organic thioethers as disclosed in U.S. Pat. Nos. 3,271,157, 3,531,289 and 3,574,628; Japanese Provisional Patent Publications No. 1019/1979 and No. 158917/1979, (b) thiourea derivatives as disclosed in Japanese Provisional Patent Publications No. 82408/1978, No. 77737/1980 and No. 2982/1980, (c) a solvent for silver halide having a thiocarbonyl group sandwitched between oxygen or sulfur atom and nitrogen atom as disclosed in Japanese Provisional Patent Publication No. 144319/1978, (d) imidazoles as disclosed in Japanese Provisional Patent Publication No. 100717/1979, (e) sulfites, (f) thiocyanates, etc.

Typical compounds of these solvents for silver halide are shown below.

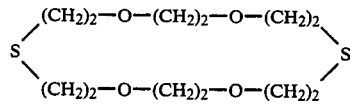
(a)

$HO-(CH_2)_2-S-(CH_2)_2-S-(CH_2)_2OH$ $CH_2-NHCOCH_2CH_2COOH$
$CH_2-S-CH_2CH_2SC_2H_5$

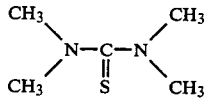
(b)

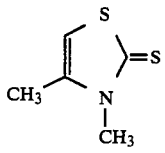
(c)

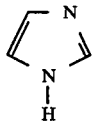
(d)

$K_2SO_3$ (e)
$NH_4SCN$ (f)
KSCN (g)

Particularly preferable solvents are thiocyanates and tetramethylthioureas. The amount of the solvent used in this invention may vary depending on the kind of the solvent employed and other factors, but in the case of, for example, a thiocyanate, a preferable amount may range from 5 mg to 1 g per mole of silver halide.

For the purpose of preventing the occurrence of a photographic fog during a manufacturing process, a storage or a developing treatment, and stabilizing photographic properties, a variety of compounds may be added to the silver halide grains at the time of the completion of the chemical ripening.

Antifoggants and stabilizers which can be used for the aforesaid purposes include many known compounds, for example, azoles such as benzothiazolium salts, nitroindazoles, nitrobenzimidazoles, chlorobenzimidazoles, bromobenzimidazols, mercaptothiazoles, mercaptobenzimidazols, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds such as oxazolinethione, and also benzenethiosulfinic acid, benzenesulfinic acid, benzenesulfonamide, hydroquinone derivatives, aminophenol derivatives, gallic acid derivatives and ascorbic acid derivatives. These additives are preferably added on the chemical ripening or before the coating process.

As a binder employed for the silver halide emulsion of the present invention, a variety of hydrophilic colloid can be employed in addition to gelatins. The gelatins include not only a gelatin but also gelatin derivatives. As the gelatin derivatives, there may be included a reaction product of the gelatin and an acid anhydride, a reaction product of the gelatin and an isocyanate, or a reaction product of the gelatin and a compound having an active halogen atom, and the like. The above-mentioned acid anhydrides used in these reactions with the gelatin include, for example, maleic anhydride, phthalic anhydride, benzoic anhydride, acetic anhydride, isatoic acid anhydride, succinic anhydride and the like, and the above-mentioned isocyanate compounds include, for example, phenyl isocyanate, p-bromophenyl isocyanate, p-chlorophenyl isocyanate, p-tolyl isocyanate, p-nitrophenyl isocyanate, naphthyl isocyanate and the like.

Further, the compounds having active halogen atoms include, for example, benzenesulfonyl chloride, p-methoxybenzenesulfonyl chloride, p-phenoxybenzenesulfonyl chloride, p-bromobenzenesulonyl chloride, p-toluenesulfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthaloyl chloride, p-nitrobenzoyl chloride, benzoyl chloride, ethyl chlorocarbonate, furoyl chloride and the like.

As the hydrophilic colloids used to prepare the silver halide emulsion, besides the above-mentioned derivative gelatins and conventional gelatins for photography, there can be used, if desired, colloidal albumin, agar, gum arabic, dextran, alginic acid, cellulose derivatives such as cellulose acetates in which hydrolysis has been accomplished until an acetyl content gets to a level of 19 to 26%, polyacrylamide, imido groups-containing polyacrylamides, casein, vinyl alcohol polymers containing urethane carboxyl groups or a cyanoacetyl groups such as vinyl alcohol-vinyl cyanoacetate copolymer, polyvinyl alcohol-polyvinyl pyrrolidones, hydrolized polyvinyl acetates, polymers obtained by polymerization of proteins or acyl saturated proteins with monomers having vinyl groups, polyvinylpyridines, polyvinylamines, polyaminoethyl methacrylates, polyethylene imines and the like.

For various purposes such as coating aid, antistatic, slide improvement, emulsion dispersion, adhesion prevention and improvement of photographic properties (e.g., development acceleration, high contrast and sensitization), a variety of known surface active agents may be included in the silver halide emulsion according to this invention.

Namely, as described in U.S. Pat. Nos. 2,240,472, 2,831,766, 3,158,484, 3,210,191, 3,294,540 and 3,507,660; U.K. Pat. Nos. 1,012,495, 1,022,878, 1,179,290 and 1,198,459; U.S. Pat. Nos. 2,739,891, 2,823,123, 1,179,290, 1,198,450, 2,739,891, 3,068,101, 3,415,649, 3,666,478 and 3,756,828; U.K. Pat. Nos. 1,397,218, 3,113,816, 3,411,413, 3,473,174, 3,345,974, 3,726,683 and 3,843,368; Belgian Pat. No. 731,126; U.K. Pat. Nos. 1,138,514, 1,159,825 and 1,374,780; U.S. Pat. Nos. 2,271,623, 2,288,226, 2,944,900, 3,235,919, 3,671,247, 3,772,021, 3,589,906, 3,666,478 and 3,754,924; West German Patent Application (OLS) No. 1,961,683; Japanese Provisonal Patent Publications Nos. 117414/1975 and 59025/1975; and Japanese Patent Publications Nos. 378/1965, 379/1965 and 13822/1968. There can be used nonionic surface active agents, for example, saponin (steroid series), alkyleneoxide derivatives (e.g. polyethylene glycol, condensates of polyethylene glycol/polypropylene glycol, polyethylene glycol alkyl- or alkylaryl-ether polyethylene glycol esters, polyethylene glycol sorbitan esters, polyalkyleneglycol alkylamines or amides, polyethylene oxide additives of silicones), glycidol derivatives (e.g. alkenyl succinic acid polyglyceride, alkylphenol polyglyceride), fatty acid esters of polyvalent alcohols, alkylesters of sugar, urethanes or ethers of the sugar; anionic surface active agents having an acidic group (e.g. a carboxy group, sulfo group, phospho group, sulfuric ester group, phosphoric ester group) such as triterpenoid seires saponin, alkylcarboxylic acid salts, alkylnaphthalene sulfonic acid salts, alkylsulfuric esters, alkyl phosphoric esters, N-acyl-N-alkyltaurines, sulfosuccinic acid esters, sulfoalkyl polyoxyethylene alkylphenyl ethers, polyoxyethylene alkylphosphoric acid esters; amphoteric surface active agents such as amino acids, aminoalkyl sulfonic acids, aminoalkylsulfuric acid ester or phosphoric acid esters, alkylbetaines, amineimides and amineoxides; and cationic surface active agents such as alkylamine salts, aliphatic or aromatic quaternary ammonium salts, heterocyclic (e.g. pyridinium, imidazolium) quaternary ammonium salts, and sulfonium compounds containing aliphatic or heterocyclic ring or sulfonium salts.

In the silver halide emulsion according to the invention, they may include, as development accelerators, in addition to the above-mentioned surfactants, imidazoles, thioethers and selenoethers discribed in West German Patent Application (OLS) Nos. 2,002,871, 2,445,611 and 2,360,878; and U.K. Pat. No. 1,352,196.

In the case that the silver halide emulsion according to this invention is used as a color light-sensitive material, usual techniques and materials for the color light-sensitive material can be employed. That is to say, a cyan coupler, a magenta coupler and a yellow coupler are combinedly added to the red-sensitive silver halide emulsion, the green-sensitive silver halide emulsions and the blue-sensitive emulsion. It is preferred that these couplers have hydrophobic groups called ballast groups and are non-diffusible. Each coupler may be tetra-equivalent or diequivalent to a silver ion. Further, a colored coupler having an effect of a color correction or a coupler (so-called DIR coupler) for giving off development restrainers during the development process may be included in the emulsion. Furthermore, the coupler above may be a coupler by the use of which a product of a coupling reaction will become colorless.

As the yellow couplers, known open chain ketomethylene couplers can be employed. Among them, benzoylacetoanilide and pivaloylacetoanilide series compounds are advantageous. Examples of these usable yellow couplers are disclosed in U.S. Pat. Nos. 2,875,057, 3,265,506, 3,408,194, 3,551,155, 3,582,322, 3,725,072 and 3,891,445; West German Pat. No. 1,547,868; West German Patent Applications (OLS) Nos. 2,213,461, 2,219,917, 2,261,361, 2,414,006 and 2,263,875.

As the magenta couplers, there can be employed pyrazolone compounds, indazolone compounds and cyanoacetyl compounds. Particularly, the pyrazolone compounds are advantageous. Examples of the usable megenta couplers are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 1,810,464; West German Patent Applications (OLS) Nos. 2,408,665, 2,417,945, 2,418,959, 2,424,467; and Japanese Patent Publication No. 6031/1965.

As the cyan couplers, there can be employed phenol compounds, naphthol compounds and the like. Examples of the cyan couplers are disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383 and 3,767,411; West German Publications (OLS) Nos. 2,414,830 and 3,454,329; and Japanese Provisional Patent Publication No. 59838/1973.

Examples of the usuable colored couplers are disclosed in, for example, U.S. Pat. Nos. 3,476,560, 2,521,908 and 3,034,892; Japanese Patent Publications Nos. 2016/1969, 22335/1963, 11304/1967 and 32461/1969; and West German Patent Application (OLS) No. 2,418,959.

Examples of the usuable DIR couplers are disclosed in U.S. Pat. Nos. 3,227,554, 3,617,291, 3,701,783, 3,790,384 and 3,632,345; West German Patent Applications (OLS) Nos. 2,414,006, 2,454,301 and 2,454,329; and U.K. Pat. No. 953,454.

The light-sensitive photographic material may additionally contain a development inhibitor-releasing compound other than the DIR couplers, and usuable examples of such compounds are described in U.S. Pat. Nos. 3,297,445 and 3,379,529; and West German Pat. Application (OLS) No. 2,417,914. Further, the couplers as described in Japanese Provisional Patent Publications Nos. 85549/1980, 94752/1982, 65134/1981, 135841/1981, 130761/1979 and 133734/1981; U.S. Pat. No. 4,310,618; U.K. Pat. No. 2,083,640; Research Disclosures Nos. 18360 (1979), 14850 (1980), 19033 (1980), 19146 (1980), 20525 (1981) and 21728 (1982) can be also employed.

Two or more of the above-mentioned couplers can be included in one layer, and one compound may be included in two or more layers.

The introduction of the coupler into the silver halide emulsion layer may be carried out by a known manner, e.g., a procedure described in U.S. Pat. No. 2,322,027. For example, phthalic acid alkyl esters (e.g. dibutyl phthalate, dioctyl phthalate), phosphates (e.g. diphenyl phosphate, triphenyl phosphate, tricresyl phosphate, dioctylbutyl phosphate), citrates (e.g. tributyl acetyl citrate), benzoic acid esters (e.g. octyl benzoate) and the like, or an organic solvent having boiling point of about 30° C. to 150° C. such as lower alkyl acetates (ethyl acetate, butyl acetate), ethyl propionate, secondary butyl alcohol, methyl isobutyl ketone, $\beta$-ethoxyethylacetate, methyl cellosolve acetate and the like. The above-mentioned organic solvents having the high boiling points and organic solvents having low boiling points may be incorporated with each other.

In case the coupler has an acidic group such as a carboxylic acid or a sulfonic acid, the coupler can be introduced into the hydrophilic colloid in the form of an alkaline aqueous solution.

These couplers are each added to the silver halide emulsion layer usually in an amount of $2\times10^{-3}$ mole to $5\times10^{-1}$ mole, preferably $1\times10^{-2}$ mole to $5\times10^{-1}$ mole per mole of silver.

The light-sensitive material prepared according to the present invention may contain hydroquinone derivatives, aminophenol derivatives, gallic acid derivative or ascorbic acid derivatives as color antifoggants, and typical examples of other color antifoggants are disclosed in U.S. Pat. Nos. 2,360,290, 2,336,327, 2,403,721, 2,418,613, 2,675,314, 2,701,197, 2,704,713, 2,728,659, 2,732,300 and 2,735,765; Japanese Provisional Patent Publications Nos. 92988/1975, 92989/1975, 93928/1975 and 110337/1975; and Japanese Patent Publication No. 23813/1975.

As an antistatic agent, there may be effectively used alkali salts of the reaction product between diacetyl cellulose, styrene-perfluoroalkyllithium maleate copolymer, styrene-manelic anhydride copolymer with p-aminobenzenesulfonic acid. As a matting agent, there may be included polymethylmethacryalte, polystyrene and alkali soluble polymers. Further, colloidal silicon oxide may also be available. As a latex to be added for improvement of film properties, there may be included copolymers of an acrylic acid ester or a vinyl ester with other monomers having other ethylenic groups. As a gelatin plasticizer, there may be employed glycerine or a glycolic compound, while as a thickner, styrene-sodium maleate copolymer, alkylvinylether-maleic acid copolymer, etc. may be employed.

As a support for the light-sensitive silver halide photographic material made from the silver halide emulsion according to this invention as prepared above, there may be mentioned, for example, baryta paper, polyethylene coated paper, polypropylene synthetic paper, glass paper, cellulose acetate, cellulose nitrate, polyvinyl acetal, polypropylene, polyester film such as polyethyleneterephthalate, polystyrene, etc., and these supports may be suitably selected depending on the respective intended use of the light-sensitive silver halide phtographic material.

These supports may be applied with a subbing treatment, if desired.

The light-sensitive silver halide photographic material made by use of the silver halide emulsion according to this invention can be developed after exposure according to a known method conventionally used.

A monochromatic developer is an alkali solution containing a developing agent such as hydroxybenzenes, amonophenols, aminobenzenes, etc., containing optionally other compounds such as alkali metal salts of sulfites, carbonates, bisulfites, bromides and iodides. When said light-sensitive silver halide color photographic material is used for color photography, it can be subjected to color developing according to the color developing method conventionally used. According to the reversal process, development is first conducted with a monochromatic nega developer, followed by application of white light exposure or treatment with a bath containing a fog agent, and further color development is effected with an alkali developer containing a color developing agent. The treatment method is not particularly limited, but all treatment methods may be applicable. For example, as typical examples, it is possible to apply a system in which bleach-fixing treatment is conducted after color developing, followed by, if desired, washing with water and stabilization treatment, or a system in which bleaching and fixing are separately conducted, followed by, if desired, washing with water and stabilization treatment.

The aforementioned silver halide photographic material can be applied effectively to a variety of the light-sensitive materials for use in a general black-and-white photography, X-ray photography, color photography, infrared photography, microphotography, silver dye bleach process, reversal process and diffusion transfer process.

This invention will be described in the concrete in accordance with examples.

totetrazole as stabilizers, saponin as a coating aid and 1,2-bis(vinyl sulfonyl)ethane as a hardening agent in suitable amounts and 3 g of polyvinyl pyrrolidone. Further, thereto was added a mixed dispersion of a cyan coupler below, dodecyl galate, tricresyl phosphate, ethyl acetate, sodium triisopropylnaphthalenesulfonate and gelatin.

(Cyan coupler)

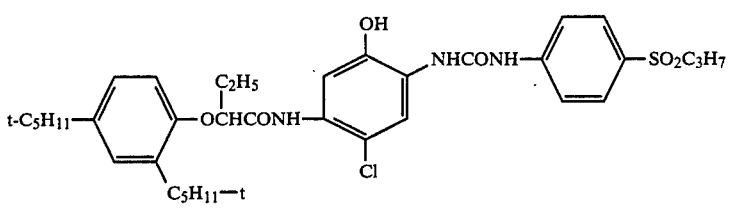

EXAMPLE 1

According to the same procedure as in Japanese Provisional Patent Publication No. 154232/1982, the following emulsions A and B were prepared. Emulsion A was a silver iodobromide emulsion (silver iodide content 8 mole %, grain diameter distribution $S/\bar{r}=0.12$) comprising silver halide grains of tetradecahedral crystals each having an average grain size of 0.56μ, with the silver iodide being uniformly distributed in the silver halide grains. Emulsion B above was a core/shell type silver iodobromide emulsion (silver iodobromide content 8 mole %, grain size distribution $S/\bar{r}=0.13$) in which each core of the aforesaid emulsion A is coated with a shell substantially comprising silver bromide and having a thickness of 0.015μ.

To each of the thus prepared emulsions A and B, there were added sensitizing dyes represented by the above-mentioned general formulae (I), (II) and (III) according to this invention, sodium thiosulfate, chloroaurate and ammonium thiocyanate, and a chemical ripening and a spectral sensitization were then carried out under the respective optimum conditions.

TABLE 1

| Sample | Emulsion | Compound of Formula (I) (mM/M of AgX) | Compound of Formula (II) (mM/M of AgX) | Compound of Formula (III) (mM/M of AgX) |
|---|---|---|---|---|
| 1 | A | (I-6) 0.20 | (IIA-1) 0.06 | — |
| 2 | B | (I-6) 0.20 | (IIA-1) 0.06 | — |
| 3 | A | (I-6) 0.20 | (IIB-1) 0.06 | — |
| 4 | B | (I-6) 0.20 | (IIB-1) 0.06 | — |
| 5 | A | (I-6) 0.20<br>(I-47) 0.02 | (IIA-1) 0.02 | (III-10) 0.06 |
| 6 | B | (I-6) 0.20<br>(I-47) 0.02 | (IIA-1) 0.02 | (III-10) 0.06 |
| 7 | A | (I-6) 0.20<br>(I-47) 0.02 | (IIB-1) 0.02 | (III-10) 0.06 |
| 8 | B | (I-6) 0.20<br>(I-47) 0.02 | (IIB-1) 0.02 | (III-10) 0.06 |
| 9 | A | (I-6) 0.20<br>(I-47) 0.02 | (IIA-5) 0.02 | (III-10) 0.06 |
| 10 | B | (I-6) 0.20<br>(I-47) 0.02 | (IIA-5) 0.02 | (III-10) 0.06 |
| 11 | A | (I-6) 0.20<br>(I-47) 0.02 | (IIA-8) 0.02 | (III-10) 0.06 |
| 12 | B | (I-6) 0.20<br>(I-47) 0.02 | (IIA-8) 0.02 | (III-10) 0.06 |
| 13 | A | (I-3) 0.20<br>(I-47) 0.02 | (IIA-20) 0.02 | (III-10) 0.06 |
| 14 | B | (I-3) 0.20<br>(I-47) 0.02 | (IIA-20) 0.02 | (III-10) 0.06 |

Then, to each emulsion, there were added 4-hydroxy-6-methyl-1,3,3a,7-tetrazaindene and 1-phenyl-5-mercap- Cellulose triacetate base supports were coated with the thus prepared emulsions and were dried to form samples. Next, the samples were subjected to 1/50 second's Wedge exposure through a green filter, and a color negative development was carried out in accordance with the undermentioned conditions.

| <Development condition><br>[Treating process] (38° C.) | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilization | 1 min. 30 sec. |

Compositions of the processing solutions used in the respective processing steps were as follows:

| | |
|---|---|
| [Composition of color developing solution] | |
| 4-Amino-3-methyl-N—ethyl-N—(β-hydroxyethyl)-aniline sulfate | 4.8 g |
| Anhydrous sodium sulfite | 0.14 g |
| Hydroxylamine.½ sulfate | 1.98 g |
| Sulfuric acid | 0.74 mg |
| Anhydrous potassium carbonate | 28.85 g |
| Anhydrous sodium hydrogen carbonate | 3.46 g |
| Anhydrous potassium sulfite | 5.10 g |
| Potassium bromide | 1.16 g |
| Sodium chloride | 0.14 g |
| Nitriltriacetic acid trisodium salt (monohydrate) | 1.20 g |
| Potassium hydroxide | 1.48 g |
| (make up to one liter with addition of water) | |
| [Composition of bleaching solution] | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| (make up to one liter with addition of water and adjust to pH 6.0) | |
| [Composition of fixing solution] | |
| Ammonium thiosulfate | 175.0 g |
| Anhydrous sodium sulfite | 8.6 g |
| Sodium metasulfite | 2.3 g |
| (make up to one liter with addition of water and adjust to pH 6.0) | |
| [Composition of stabilizing solution] | |
| Formalin (37% aqueous solution) | 1.5 ml |
| Konidax (Trade name, produced by Konishiroku Photo Industry, Co., Ltd.) | 7.5 ml |
| (make up to one liter with addition of | |

-continued

| |
|---|
| water) |

For the resulting dye images, density meaurement was carried out through a green filter to obtain green light sensitivities (Sr) and photographic fogs. Each sensitivity was obtained from an exposure necessary to provide an optical density of "a fog+0.1". Results of sensitometries are set forth in Table 2 below. The sensitivities in the table are relatively represented taking the sensitivity of emulsion A as 100.

TABLE 2

| | | Allowed to stand 1 day at room temp. (Standard) | | Allowed to stand 5 days at 55° C. | |
|---|---|---|---|---|---|
| Sample | Emulsion | Relative sensitivity Sr | Fog | Relative sensitivity Sr | Fog |
| 1 | A | 100 | 0.015 | 120 | 0.045 |
| 2 | B | 452 | 0.010 | 460 | 0.020 |
| 3 | A | 100 | 0.012 | 108 | 0.033 |
| 4 | B | 366 | 0.011 | 371 | 0.016 |
| 5 | A | 100 | 0.020 | 110 | 0.057 |
| 6 | B | 403 | 0.015 | 415 | 0.025 |
| 7 | A | 100 | 0.019 | 123 | 0.040 |
| 8 | B | 477 | 0.018 | 480 | 0.021 |
| 9 | A | 100 | 0.022 | 105 | 0.063 |
| 10 | B | 502 | 0.018 | 510 | 0.024 |
| 11 | A | 100 | 0.013 | 99 | 0.049 |
| 12 | B | 301 | 0.009 | 311 | 0.015 |
| 13 | A | 100 | 0.012 | 127 | 0.036 |
| 14 | B | 398 | 0.011 | 402 | 0.014 |

The results in this table indicate that samples 2, 4, 6, 8, 10, 12 and 14 in which emulsion B and combinations of the sensitizing dyes regarding this invention were employed are all high sensitive and stably maintain the sensitivity and the fog inhibition even during the storage at a high temperature, in contract to the comparative samples (emulsion A).

EXAMPLE 2

According to a double jet method, the following emulsions C, D and E were prepared. Emulsion C was an emulsion of a silver iodobromide polydispersed twins (grain size distribution $S/\bar{r}=0.34$; a silver iodide content 7 mole %; and the silver iodide was uniformly distributed in the grains) each having an average grain diameter of 0.6μ. Emulsion D above was an emulsion of monodispersed core/shell type octahedral silver iodobromide crystals (grain size distribution $S/\bar{r}=0.15$; each shell was substantially composed of silver bromide and had a thickness of 0.015μ; and a silver iodide content was 7 mole %). And emulsion E was an emulsion of monodispersed core/shell type tetradecahedral silver iodobromide crystals (grain size distribution $S/\bar{r}=0.12$; each shell was substantially composed of silver bromide and had a thickness of 0.015μ; and a silver iodide content was 7 mole %).

The thus prepared emulsions were subjected to an optimum chemical ripening, and sensitizing dyes represented by the above-mentioned general formulae (I), (II) and (III) regarding this invention were added to the respective emulsions in accordance with Table 3 below.

To each emulsion, there were then added 4-hydroxy-6-methyl-1,3,3a,7-tetrazaindene as a stabilizer, saponin as a coating aid and formalin as a hardening agent in suitable amounts. Afterward, cellulose triacetate base supports were coated with the thus prepared emulsions and dried to form samples.

The formed samples were subjected to 1/50 second's Wedge exposure through a red filter, and development was carried out at 30° C. for 2 minutes by the use of a developing solution having the following composition, followed by fixing and rinsing with water.

| [Composition of the developing solution] | |
|---|---|
| Sulfuric acid-p-methylaminophenol | 3 g |
| Anhydrous sodium sulfite | 50 g |
| Hydroquinone | 6 g |
| Sodium carbonate | 29.5 g |
| Potassium bromide | 1 g |
| (Make up to one liter with addition of water) | |

For the resulting silver images, density measurement was carried out to obtain red light sensitivities (Sr) and photographic fogs. These sensitivities were relatively exhibited taking the sensitivity of emulsion C as 100.

TABLE 3

| Sample | Emulsion | Compound of Formula (I) (mM/M of AgX) | Compound of Formula (II) (mM/M of AgX) | Compound of Formula (III) (mM/M of AgX) |
|---|---|---|---|---|
| 15 | C | (I-6) 0.20 (I-47) 0.02 | (IIA-5) 0.03 | (III-10) 0.06 |
| 16 | D | (I-6) 0.20 (I-47) 0.02 | (IIA-5) 0.03 | (III-10) 0.06 |
| 17 | E | (I-6) 0.20 (I-47) 0.02 | (IIA-5) 0.03 | (III-10) 0.06 |
| 18 | C | (I-6) 0.20 (I-47) 0.02 | (IIA-8) 0.06 | — |
| 19 | D | (I-6) 0.20 (I-47) 0.02 | (IIA-8) 0.06 | — |
| 20 | E | (I-6) 0.20 (I-47) 0.02 | (IIA-8) 0.06 | — |
| 21 | C | (I-6) 0.20 (I-47) 0.02 | (IIA-20) 0.03 (IIB-15) 0.03 | — |
| 22 | D | (I-6) 0.20 (I-47) 0.02 | (IIA-20) 0.03 (IIB-15) 0.03 | — |
| 23 | E | (I-6) 0.20 (I-47) 0.02 | (IIA-20) 0.03 (IIB-15) 0.03 | — |

TABLE 4

| | | Allowed to stand 1 day at room temp. (Standard) | | Allowed to stand 5 days at 55° C. | |
|---|---|---|---|---|---|
| Sample | Emulsion | Relative sensitivity Sr | Fog | Relative sensitivity Sr | Fog |
| 15 | C | 100 | 0.015 | 126 | 0.037 |
| 16 | D | 158 | 0.012 | 162 | 0.014 |
| 17 | E | 145 | 0.013 | 150 | 0.016 |
| 18 | C | 100 | 0.016 | 112 | 0.041 |
| 19 | D | 172 | 0.012 | 178 | 0.017 |
| 20 | E | 167 | 0.012 | 177 | 0.019 |
| 21 | C | 100 | 0.010 | 120 | 0.044 |
| 22 | D | 193 | 0.009 | 200 | 0.013 |
| 23 | E | 200 | 0.010 | 210 | 0.018 |

As be definite from the above-mentioned tables, samples 16, 17, 19, 20, 22 and 23 in which the monodispersed emulsions and combinations of sensitizing dyes regarding this invention were employed are all excellent in a sensitizing effect and stably maintain the sensitivity and the fog inhibition even during the storage at a high temperature, in contrast to the comparative Samples 15, 18 and 21 in which the polydispersed emulsions were used and the sensitization was similarly carried out.

We claim:

1. A light-sensitive silver halide color photographic material having at least one silver halide emulsion layer on a support, characterized in that said silver halide emulsion layer includes substantially monodispersed non-tabular silver halide grains having a configuration of octahedral or tetradecahedral; said silver halide grains are core/shell type silver halide grains in which a silver iodide content is higher in core portions than in shell portions, said silver halide grains having regular grain sizes, and having a grain size distribution as defined by the following formula:

$$S = \sqrt{\frac{\Sigma (\bar{r} - r_i)^2 n_i}{\Sigma n_i}}$$

$$\frac{S}{\bar{r}} \leqq 0.20$$

wherein S represents the standard deviation; $\bar{r}$ represents the average grain size; $r_i$ represents individual grain sizes; and $n_i$ represents numbers of $r_i$; provided that the $\bar{r}$ is defined by the following formula:

$$\bar{r} = \frac{\Sigma n_i r_i}{\Sigma n_i}$$

wherein $n_i$ and $r_i$ have the same meanings as defined above, said core portion of the silver halide grains comprising silver iodide at a level of 2 to 15 mole %; and said shell portion of the silver halide grains comprising silver iodide at a level of 0 to 4 mole %; and said silver halide grains are those which have been sensitized with a combination of at least one of sensitizing dyes represented by the following general formula (I) and at least one of sensitizing dyes represented by the following general formula (II):

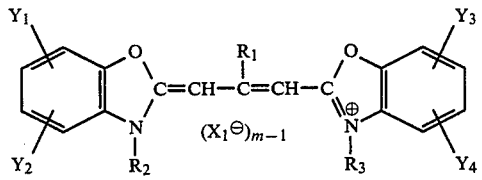

(I)

wherein $R_1$ represents a hydrogen atom, an alkyl group or aryl group; $R_2$ and $R_3$ each represent an alkyl group; $Y_1$ and $Y_2$ each represent a sulfur atom or selenium atom; $Z_1$, $Z_2$, $Z_3$ and $Z_4$ each represent a hydrogen atom, halogen atom, hydroxyl group, alkoxy group, amino group, acylamido group, acyloxy group, alkoxycarbonyl group, alkoxycarbonylamino group, aryl group, alkyl group or cyano group, at least one of (i) $Z_1$ and $Z_2$, and (ii) $Z_3$ and $Z_4$ may be coupled to each other to form a ring; $X_1^{\ominus}$ represents an anion; and m is an integer of 1 or 2, provided that the sensitizing dye forms an internal salt, when the m is 1;

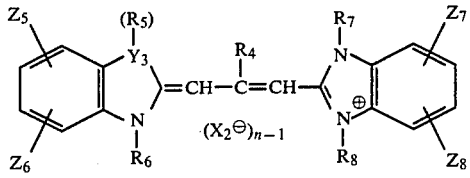

(II)

wherein $R_4$ is a hydrogen atom, alkyl group or aryl group; $R_5$, $R_6$, $R_7$ and $R_8$ each represent an alkyl group; $Y_3$ represents a nitrogen atom, sulfur atom or selenium atom, provided that the $Y_3$ is the sulfur atom or selenium atom, the $R_5$ is not present; $Z_5$, $Z_6$, $Z_7$ and $Z_8$ each represent a hydrogen atom, halogen atom, hydroxyl group, alkoxy group, amino group, acylamido group, acyloxy group, alkoxycarbonyl group, aryloxycarbonyl group, alkoxycarbonylamino group, aryl group, alkyl group, cyano group or sulfonyl group, at least one of (i) $Z_5$ and $Z_6$, and (ii) $Z_7$ and $Z_8$ may be coupled to each other to form a ring; $X_2^{\ominus}$ represents an anion; and n is an integer of 1 to 2, provided that the sensitizing dye forms an internal salt, when the n is 1.

2. The light-sensitive silver halide color photographic material according to claim 1, wherein said sensitizing dye represented by the formula (II) is a compound represented by the following general formulae (IIA) or (IIB):

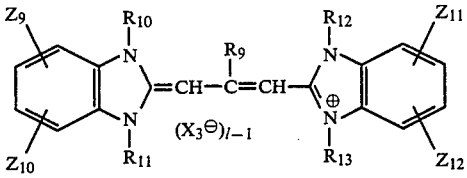

(IIA)

wherein $R_9$ represents a hydrogen atom, a lower alkyl group or an aryl group; $R_{10}$, $R_{11}$, $R_{12}$ and $R_{13}$ each represent a lower alkyl group; $Z_9$, $Z_{10}$, $Z_{11}$ and $Z_{12}$ each represent a hydrogen atom, a halogen atom, a hydroxyl group, an alkoxy group, an amino group, an acylamido group, an acyloxy group, an alkoxycarbonyl group, an aryloxycarbonyl group, an alkoxycarbonylamino group, an aryl group, a lower alkyl group, a sulfonyl group, and a cyano group, at least one of (i) $Z_9$ and $Z_{10}$, and (ii) $Z_{11}$ and $Z_{12}$ are coupled to each other to form a ring; $X_3^{\ominus}$ represents an anion; l is an integer of 1 or 2, provided that the sensitizing dye forms an internal salt when the l is 1;

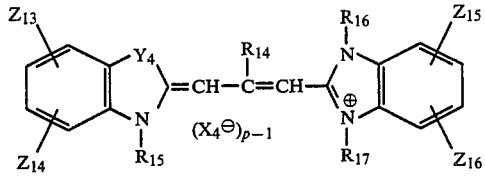

(IIB)

wherein $Y_4$ represents a sulfur atom or selenium atom; $R_{14}$ represents a hydrogen atom, a lower alkyl group or an aryl group; $R_{15}$, $R_{16}$ and $R_{17}$ each represent a lower alkyl group; $Z_{13}$, $Z_{14}$, $Z_{15}$ and $Z_{16}$ each represent a hydrogen atom, a halogen atom, a hydroxyl group, an alkoxy group, an amino group, an acrylamido group, an acyloxy group, an alkoxycarbonyl group, an alkoxycarbonylamino group, an aryl group, a lower alkyl group and a sulfonyl group, at least one of (i) $Z_{13}$ and $Z_{14}$, and (ii) $Z_{15}$ and $Z_{16}$ are coupled to each other to form a ring; $X_4\ominus$ represents an anion; and p is an integer of 1 or 2, provided that the sensitizing dye forms an internal salt when the p is 1.

3. The light-sensitive silver halide color photographic material according to claim 1, wherein said sensitizing dyes represented by the formulae (I) and (II) is used in combination with the red light sensitizing dye represented by the following general formula (III):

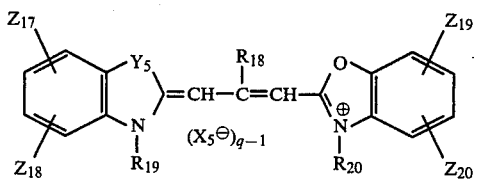

(III)

wherein $Y_5$ represents a sulfur atom or selenium atom; $R_{18}$ represents a hydrogen atom, a lower alkyl group or an aryl group; $R_{19}$ and $R_{20}$ each represent a lower alkyl group; $Z_{17}$, $Z_{18}$, $Z_{19}$ and $Z_{20}$ each represent a hydrogen atom, a halogen atom, a hydroxyl group, an alkoxy group, an amino group, an acylamido gorup, an acyloxy group, an alkoxycarbonyl group, an alkoxycarbonylamino group, an aryl group and a lower alkyl group; $X_5\ominus$ represents an anion; q is an integer of 1 or 2, provided that the sensitizing dye forms an internal salt when the q is 1.

4. The light-sensitive silver halide color photographic material according to claim 1, wherein said core/shell type silver halide grains comprise shells having a thickness of 0.001 to 0.1$\mu$.

5. The light-sensitive silver halide color photographic material according to claim 1, wherein the $Z_1$ and $Z_2$ and the $Z_3$ and $Z_4$ are coupled to each other to form a benzene ring, respectively.

6. The light-sensitive silver halide color photographic material according to claim 1, wherein the anions of $X_1\ominus$ and $X_2\ominus$ each represent chloride, bromide, iodide, thiocyanate, sulfamate, methyl sulfate, ethyl sulfate, perchlorate or p-toluene sulfonate.

7. The light-sensitive silver halide color photographic material according to claim 2, wherein the anions of $X_3\ominus$ and $X_4\ominus$ each represent chloride, bromide, iodide, thiocyanate, sulfamate, methyl sulfate, ethyl sulfate, perchlorate or p-toluene sulfonate.

8. The light-sensitive silver halide color photographic material according to claim 1, wherein the $R_1$ and $R_4$ each represent an alkyl group having 1 to 4 carbon atoms.

9. The light-sensitive silver halide color photographic material according to claim 2, wherein the $R_9$ and $R_{14}$ each represent an alkyl group having 1 to 4 carbon atoms.

10. The light-sensitive silver halide color photographic material according to claim 1, wherein said silver halide grains are grains consisting of a silver iodobromide.

11. The light-sensitive silver halide color photographic material according to claim 1, wherein said core/shell type silver halide grains are grains prepared by the double-jet method.

12. The light-sensitive silver halide color photographic material according to claim 1, wherein the silver iodide content in the silver halide grains is 5 to 12 mole %.

* * * * *